US011964810B2

(12) United States Patent
Redrup

(10) Patent No.: US 11,964,810 B2
(45) Date of Patent: Apr. 23, 2024

(54) FRACTURABLE CONTAINER

(71) Applicant: SANDS INNOVATIONS LTD, Forest Glen (AU)

(72) Inventor: Jacob Anthony Redrup, Marcoola (AU)

(73) Assignee: SANDS INNOVATIONS LTD, Queensland (AU)

( * ) Notice: Subject to any disclaimer, the term of this patent is extended or adjusted under 35 U.S.C. 154(b) by 45 days.

(21) Appl. No.: 16/604,411

(22) PCT Filed: Apr. 11, 2017

(86) PCT No.: PCT/AU2017/050315
§ 371 (c)(1),
(2) Date: Oct. 10, 2019

(87) PCT Pub. No.: WO2018/187824
PCT Pub. Date: Oct. 18, 2018

(65) Prior Publication Data

US 2020/0156842 A1 May 21, 2020

(51) Int. Cl.
*B65D 75/58* (2006.01)
*B65D 17/28* (2006.01)

(52) U.S. Cl.
CPC ..... *B65D 75/585* (2013.01); *B65D 17/402* (2018.01)

(58) Field of Classification Search
CPC .... B65D 17/402; B65D 75/585; B65D 75/36; B65D 75/366; B65D 75/367;
(Continued)

(56) References Cited

U.S. PATENT DOCUMENTS 3,036,700 A 5/1962 Krug
3,075,639 A * 1/1963 Lingley ..... A61M 5/002 206/366

(Continued)

FOREIGN PATENT DOCUMENTS

CA 2627642 C 7/2017
CN 1210497 A 3/1999

(Continued)

OTHER PUBLICATIONS

International Search Report PCT/AU2017/050315, dated Jun. 21, 2017, 4 pages.

(Continued)

*Primary Examiner* — Robert Poon
(74) *Attorney, Agent, or Firm* — Brooks Kushman P. C.; John E. Nemazi

(57) ABSTRACT

A container includes a body having a cavity for containing contents. The container includes a flange arranged about a perimeter of the body a cover is affixed to the flange for enclosing the contents within the cavity, and a fracturable portion including a bend extending across the body bisecting the body into a first and second body portions. The fracturable portion defines a break path along which the body is adapted to fracture when a user applies a force exceeding a predetermined level. The break path has an initiating fracture point and a pair of termini, at each of the flange portions, to fracture from the fracture point in opposing directions along the break path towards each terminus. The fracturable portion has a plurality of fracture conductors spaced apart along the break path defining a localized change in rigidity of the fracturable portion to guide propagation of the fracture.

18 Claims, 16 Drawing Sheets

(58) Field of Classification Search
CPC ..... B65D 83/0088; B65D 2575/362; B65D 2575/366; B65D 51/2821; B65D 75/00; B65D 75/28; B65D 75/32; B65D 75/325–328; B65D 75/368; B65D 43/162; B65D 73/00; B65D 73/0092
USPC ..... 206/469–470
See application file for complete search history.

(56) References Cited

U.S. PATENT DOCUMENTS 3,437,199 A * 4/1969 Jacobson ..... B65D 75/366 220/838
3,472,368 A * 10/1969 Hellstrom ..... B65D 75/32 206/469
3,521,805 A * 7/1970 Ward ..... B65D 75/5822 206/532
3,635,376 A 1/1972 Hellstrom
3,741,384 A 6/1973 Cloud
3,986,640 A 10/1976 Redmond
4,106,621 A * 8/1978 Sorenson ..... A61M 5/002 206/365
4,155,454 A * 5/1979 Ryden ..... B65D 75/527 206/532
4,341,302 A 7/1982 Baker et al.
4,493,574 A * 1/1985 Redmond ..... B65D 75/368 401/132
4,611,715 A 9/1986 Redmond
4,724,982 A 2/1988 Redmond
4,871,091 A 10/1989 Preziosi
4,921,137 A 5/1990 Heijenga
4,938,462 A 7/1990 Gould
5,009,894 A 4/1991 Hsiao
RE34,087 E 10/1992 Redmond
5,316,400 A * 5/1994 Hoyt ..... B65D 75/323 401/196
5,395,031 A 3/1995 Redmond
5,494,192 A 2/1996 Redmond
5,582,330 A 12/1996 Iba
5,826,737 A 10/1998 Zakensberg
5,839,609 A 11/1998 Zakensberg
6,041,930 A 3/2000 Cockburn
6,070,723 A 6/2000 Lewis
6,085,942 A 7/2000 Redmond
6,241,124 B1 6/2001 Hoyt
6,460,781 B1 10/2002 Garcia et al.
6,663,019 B2 12/2003 Garcia et al.
6,726,054 B2 4/2004 Fagen et al.
6,860,405 B1 3/2005 Poynter
6,874,665 B2 4/2005 Doherty et al.
6,957,909 B1 10/2005 Dingeldein et al.
7,004,322 B1 2/2006 Bartoli
7,005,109 B2 2/2006 Husar
7,104,419 B2 9/2006 Fagen et al.
7,121,409 B1 10/2006 Hamilton et al.
7,270,239 B1 9/2007 Ross
7,320,398 B2 1/2008 Bertl et al.
7,325,703 B2 2/2008 Gherdan et al.
7,413,080 B2 8/2008 Van House
7,431,529 B1 10/2008 Rushe et al.
7,487,894 B2 2/2009 Zahn et al.
7,506,762 B2 3/2009 Nelson et al.
7,513,397 B2 4/2009 Zahn et al.
7,556,147 B2 7/2009 Leiner et al.
7,562,796 B2 7/2009 Zahn et al.
7,669,597 B2 3/2010 Sullivan et al.
7,703,619 B2 4/2010 Van Puijenbroek
D636,890 S 4/2011 Teys et al.
8,028,837 B2 10/2011 Gerstle et al.
8,091,242 B2 1/2012 Teys et al.
8,151,984 B2 4/2012 Braeder et al.
8,485,360 B2 7/2013 Teys et al.
8,511,500 B2 8/2013 Teys et al.
8,523,016 B2 9/2013 Teys
8,528,736 B2 9/2013 Teys et al.
8,919,594 B2 12/2014 Teys
9,260,231 B2 2/2016 Havrileck et al.
2003/0015605 A1 1/2003 Garcia et al.
2006/0131208 A1* 6/2006 Morrison ..... B65D 67/02 206/703
2006/0283727 A1 12/2006 Nelson et al.
2007/0125667 A1 6/2007 Lee et al.
2008/0002921 A1 1/2008 Redmond
2008/0072432 A1 3/2008 Teys et al.
2009/0050649 A1 2/2009 Rushe et al.
2010/0065582 A1 3/2010 Nelson et al.
2010/0116772 A1 5/2010 Teys
2011/0024462 A1 2/2011 Teys et al.
2011/0100859 A1 5/2011 Burattini
2011/0290800 A1 12/2011 Teys
2012/0223075 A1* 9/2012 Teys ..... B65D 75/366 220/268
2015/0136639 A1* 5/2015 Aranda Lopez ..... B65D 1/09 206/530
2016/0090221 A1 3/2016 Stevens et al.
2017/0166379 A1* 6/2017 Larsen ..... B65D 75/366

FOREIGN PATENT DOCUMENTS

CN 105143068 A 12/2015
DE 2232861 A1 1/1974
DE 19627243 A1 1/1998
EP 496587 A2 7/1992
GB 890770 A 3/1962
JP 2005271937 A 10/2005
JP 2010516579 A 5/2010
JP 2012116514 A 6/2012
JP 2012527380 A 11/2012
JP 5452883 B2 3/2014
JP 2014509994 A 4/2014
KR 1020130062072 A 6/2013
WO 97/28054 8/1997
WO 1997034816 A1 9/1997
WO 2004063048 A1 7/2004
WO 2005065498 A1 7/2005
WO 2007082034 A2 7/2007
WO 2008092200 A1 8/2008
WO 2009011571 A1 1/2009
WO 2010065980 A1 6/2010
WO 2012120344 A2 9/2012
WO 2012154051 A1 11/2012
WO 2014135884 A2 9/2014
WO 2014186816 A1 11/2014

OTHER PUBLICATIONS

International Search Report for PCT/AU2017/050315, dated Jun. 21, 2017.

* cited by examiner

SECTION P-P

SECTION Q-Q

FRACTURABLE CONTAINER

CROSS-REFERENCE TO RELATED APPLICATIONS

This application is the U.S. national phase of PCT Application No. PCT/AU2017/050315 filed on Apr. 11, 2017, the disclosures of which is incorporated in its entirety by reference herein.

FIELD OF THE INVENTION

The present invention relates to the field of containers and particularly to containers which can be opened by fracturing along a break path.

BACKGROUND TO THE INVENTION

Containers are used for a variety of products and will often have a desired or required shape depending on the product being contained or for aesthetic purposes. Many current containers include a body that defines a cavity for containing material and a lid to cover an opening over the cavity. Such containers can be opened along a desired path through weakening of a wall of the body by using perforations, scoring or thinning along a line. It is undesirable in some circumstances to use weakened walls because this can lead to unwanted opening of the container or poor barrier performance along the weakening.

Some alternative containers have geometric fracture features where an opening is formed in the body of the container through the application of a force on either side of a break path. Such containers can deliver a more robust product with increased barrier performance.

U.S. Pat. No. 8,485,360, of the present applicant, provides a container with a so-called 'snap feature', fracturable along a break path that has a generally constant wall thickness across the break path. The body of the container is configured to concentrate stress along the break path by increasing the distance (y) between a neutral axis and the base surface of the bend and decreasing the second moment of area ($I_x$) at the break path. The material forming the body of the container must be brittle enough to allow the container to fracture along the break path at the bend. This arrangement provided by U.S. Pat. No. 8,485,360 is also restricted to applications with containers and break paths having certain sizes and shapes. Particularly, the break paths are limited to traversing relatively small distances. Altering the geometry of the break path, such as by increasing the length of fracture, or the material forming the container body, such as by using less brittle material, can lead to fractures that do not follow the break path consistently, form cracks or serrated edges, or that do not open all the way along the desired path. Circumstances where a container fractures along a cracked or uneven path are undesirable to consumers who consider them to be visually unappealing and who may suspect that part of the container has shattered into the product within the container. Some such cracked or uneven, or even shattered paths may also present a risk to the user who might tear their skin by getting it caught on uneven edges of the opened container.

The snap features described in US '360 limit the possibility of changing the overall appearance of the container. The requirements of the snap feature can also result in an element of dead space in the container. This means that the visual appeal of containers containing the snap features is limited and can also lead to perceptions of wasted space and over packaging.

In nature, cracks will not naturally follow a straight path. Commonly, naturally forming cracks are jagged and branched, such as cracks created in the ground following an earthquake, cracks appearing in ice or cracks in an object, such as a glass, when it has been dropped. This natural phenomenon makes it difficult to create fractures along straight lines over extended distances. This may be one reason behind the limitations of the prior art.

It would be desirable to provide a container which can be opened by fracturing that overcomes one or more of the problems associated with the prior art. For example, it would be desirable to provide one or more of: a container with a break path that is longer than previously possible; a container with a fracturable portion that can more easily follow paths in three dimensions; a container that can be shaped to more easily contain and dispense products of varying shapes and sizes; a container which can be manufactured from a lighter material; or a container which fractures along a clean path more consistently.

Any discussion of documents, devices, acts or knowledge in this specification is included to explain the context of the invention. It should not be taken as an admission that any of the material formed part of the prior art base or the common general knowledge in the relevant art on or before the priority date of the claims herein.

SUMMARY OF THE INVENTION

A first aspect of the present invention provides a container including: a body having a cavity for containing one or more contents; a flange arranged about a perimeter of the body; a cover affixed to the flange for enclosing the contents within the cavity; and a fracturable portion including a bend extending across the body from a first flange portion to a second flange portion, the fracturable portion bisecting the body into a first body portion on one side of the bend and a second body portion on the other side of the bend, wherein the fracturable portion defines a break path along which the body is adapted to fracture when a user applies a force exceeding a predetermined level to each of the first and second body portions on either side of the bend, the break path having an initiating fracture point and a pair of termini, with one said terminus at each of the first and second flange portions, such that the body is adapted to fracture from the fracture point in opposing directions along the break path towards each terminus, and wherein the fracturable portion includes a plurality of fracture conductors spaced apart from one another along the break path, each fracture conductor being defined by a localised change in rigidity of the fracturable portion such that the fracture conductors aid in guiding propagation of the fracture along the break path.

The 'break path' is a defined path along which the body of the container fractures. In other words, the beak path is the path the fracture will take when the container is opened. The 'fracturable portion' is the portion of the body of the container which fractures.

The 'predetermined level' is the amount of force above which the fracturable portion is adapted to fracture along the break path. If forces below or equal to the predetermined level are applied, the fracturable portion will not fracture and the container will remain in an unopened state. Whereas, when forces that exceed the predetermined level are applied, the fracturable portion will fracture at initiating fracture points and then along the break path until the entire break path has fractured and the container is in an opened state. The application of force to each of the first and second body portions may be provided by a user holding the second body portion securely and then pressing on a front surface of first body portion. When the force caused by holding the second body portion securely and pressing on the first body portion exceeds the predetermined level, the fracturable portion will fracture along the break path. Opening the container by fracturing along the break path may be performed through a one handed or two handed action of a user.

The fracture conductors assist the fracture to propagate along a desired path. The fracture conductors may therefore allow containers to fracture along break paths which may not be possible without the conductors in place. The fracture conductors may prevent the fracture from deviating from the break path. The fracture conductors may increase the consistency of fracturing of like containers, whereas some containers of the prior art would fracture less consistently along the desired break path. The fracture conductors therefore assist in creating a fracture on the body of the container that is aesthetically pleasing to consumers.

The change in rigidity of the fracturable portion at the fracture conductor may refer to a change in rigidity of the material from which the body of the container is formed. Alternatively, the change in rigidity of the fracturable portion at the fracture conductor may refer to the rigidity of a predetermined length of the fracturable portion at the fracture conductor being different to the same length of fracturable portion where no fracture conductor is present.

According to a preferred embodiment, each fracture conductor includes a localised change of depth of the bend. The depth of the bend is the maximum distance of a point on the bend above or below a surface level of a body portion on one side of the bend. In embodiments where the bend projects from the surface level into the cavity, the depth of the bend is the maximum distance below the surface level. Whereas, in embodiments where the bend extends from the surface level outwardly from the cavity, the depth of the bend is the maximum distance from the surface level outwardly from the cavity. The point of the bend at the maximum distance above or below the surface level is preferably on the break path. The change of depth of the bend at a fracture conductor is therefore the difference between the depth of the bend at a cross-section where no fracture conductor exists and the depth of the bend at a cross-section where a fracture conductor is present. In some embodiments, the depth of the bend at a fracture conductor is increased compared to the depth of the bend where no fracture conductor is present. In other embodiments, the depth of the bend at a fracture conductor is reduced compared to the depth of the bend where no fracture conductor is present.

One or more fracture conductors may consist of a localised change of depth of the bend. Alternatively, at least one of the fracture conductors includes a localised change of depth of the bend. Preferably, the localised change of depth of the bend extends over a distance from about 0.5 mm to about 5 mm of the break path. The localised change of depth of the bend may extend over a distance from about 1 mm to about 4 mm of the break path. The localised change of depth of the bend may extend over a distance from about 2 mm to about 3 mm of the break path. Preferably, the change of depth of the bend is from about 15% to about 90% of a total depth of the bend. More preferably, the change of depth of the bend is from about 30% to about 70% of a total depth of the bend. Most preferably, the change of depth of the bend is from about 40% to about 60% of a total depth of the bend. Alternatively, the change of depth of the bend is over 90% of a total depth of the bend. In other embodiments, the change of depth of the bend may be less than 15% of the total depth of the bend.

Preferably, at locations on the break path where no fracture conductor is present, the depth of the bend will be substantially constant. The depth of the bend at regions where no fracture conductors are present may be from about 0.1 mm to about 10 mm. Alternatively, the depth of the bend at regions where no fracture conductors are present is preferably from about 0.3 mm to about 5 mm. More preferably, the depth of the bend at regions where no fracture conductors are present is from about 0.5 to about 3 mm. The depth of the bend at regions where no fracture conductors are present is most preferably from about 2 mm to about 3 mm. The depth of the bend at regions where no fracture conductors are present may be altered as required depending on the properties of the material from which the body is formed and/or thickness of material of the body.

Alternatively or additionally, each fracture conductor includes a localised change of cross-sectional shape of the bend. The cross-sectional shape of the bend is the shape of the body at the bend along a cross-section taken perpendicularly to the bend. Preferably, the localised change of cross-sectional shape of the bend extends over a distance of 0.5 mm to 5 mm of the break path. The localised change of cross-sectional shape of the bend may include a transitional point between being recessed on a first bend portion to being recessed on a second bend portion. The first bend portion may be on the bend on one side of the break path and the second bend portion may be on the bend on the other side of the break path.

Alternatively or additionally, each fracture conductor includes a localised change of direction of the bend.

According to another embodiment, the body is formed from a crystallisable material and each fracture conductor includes a localised change of crystallisation of the material at the bend. Alternatively, at least one fracture conductor includes a localised change of crystallisation of the body material at the bend. One or more fracture conductors may consist of a localised change of crystallisation of the body material at the bend. The change of crystallisation of the material may be caused by heating or ultrasonic excitation. Alternatively, any other method may be used to cause crystallisation of the material. Preferably, the crystallisable material is a polymer material. For example, the crystallisable material may be polyethylene terephthalate (PET) or amorphous polyurethane terephthalate (APET).

The fracture conductor including or consisting of a localised change of depth at the bend or a localised change of crystallisation of the body material at the bend causes an increased rigidity of the break path at the fracture conductor compared to other sections of the break path where no fracture conductor is present. The increased rigidity means the break path is more easily fractured at the fracture conductor. An increased rigidity may additionally or alternatively mean an increased brittleness of the body at the fracture conductor. When the body is fractured, a fracture propagates along the break path from the fracture point towards each terminus. The fracture may be drawn along the break path toward and then past each fracture conductor due to the increased rigidity. The fracture may be more likely to break along the break path when fracture conductors are positioned correctly.

In possible alternative embodiments, the fracture conductors include means other than localised change of depth at the bend or a localised change of crystallisation of the body material at the bend.

In a preferred embodiment the thickness of the walls forming the body is substantially constant throughout. In other words, the thickness of the material from which the body is formed is constant throughout. The thickness of the body is preferably substantially constant across the length and width of the bend. The thickness of the body is preferably substantially constant along the entire break path. This means that the break path does not have any perforations or weakened areas caused by thinning of the thickness of the body material. Some very slight differences in thickness of the body may be caused by the manufacturing process, although these would not intentional. The substantially constant thickness of the body may provide a container which has improved barrier properties, is robust and less prone to accidental opening compared to containers which have lines of weakness caused by perforations or thinning of material.

The fracture conductors are preferably spaced apart along the break path such that the accumulative distance of fracturable portion where fracture conductors are present is less than the distance of fracturable portion where fracture conductors are absent. The number of fracture conductors along a break path may depend on the overall length of the break path. It is preferable that a larger number of fracture conductors are used on longer break paths than on shorter break paths. The number of fracture conductors may depend on the shape of the break path. It is preferable that the number of fracture conductors on break paths with a number of undulations, curves or angles is less than on break paths with fewer undulations, curves or angles. The number and position of fracture conductors may be selected depending on the shape and size of the container to optimise the consistency of fracturing when opened.

In one embodiment, the fracture conductors are spaced apart along an elongate straight section of the break path to aid in guiding propagation of the fracture along the elongate straight section of the break path. The elongate straight section of the break path may be substantially parallel to the flange. Creating consistent fractures along a break path along elongate straight sections parallel to the flange was difficult or impossible in the prior art. Spacing conductors along a straight elongate path provides localised regions of changed rigidity which assists in keeping a fracture in a straight line along the break path with a reduced probability of deviation.

According to another embodiment, the fracture conductors are positioned at transitional points on curved sections of the break path to aid in guiding propagation of the fracture along the curved sections of the break path. The transitional points on curved sections of the break path may be inflection points. An inflection point is a point on a curve at which the curve changes from being concave to convex, or vice versa. Alternatively or additionally, the transitional points on curved sections of the break path may be points where a shape of the curve changes more or less steeply than at an adjacent point on the break path. A transitional point may be a point on the break where the break path is transitioning from a straight line to a curve. In the prior art, creating curved sections of a desired shape of break path or a break path that follows one or more curves in three dimensions which would fracture consistently along the break path could be difficult or impossible.

According to a further embodiment, the fracture conductors are positioned at transitional points on angled sections of the break path to aid in guiding propagation of the fracture along the angled sections of the break path. One or more fracture conductors may be positioned at the corner of an angled transition from one substantially straight section of the break path to another substantially straight section of the break path.

Positioning the fracture conductor at a transitional point of a curved or angular section may assist in guiding the propagation of a fracture around the desired curve or angle without the fracture deviating off at a tangent.

The localised change of rigidity of the fracturable portion also means a localised change of rigidity of the break path. The localised change of rigidity of the fracturable portion at the fracture conductor means that the rigidity at the fracture conductor is different to the rigidity at points on the fracturable portion where no fracture conductor is present. In a preferred embodiment, the localised change in rigidity of the fracturable portion at the fracture conductor is an increase in the rigidity of the fracturable portion. Wherein, the rigidity of the fracturable portion at the fracture conductors includes a localised increase in rigidity compared to portions of the fracturable portion where no fracture conductor is present. Alternatively, the localised change in rigidity of the fracturable portion at the fracture conductor is a decrease in the rigidity of the fracturable portion. In circumstances where the fracture conductor has a decreased rigidity, the sections of the fracturable portion where no fracture conductor is present would have an increased rigidity compared to the sections where the fracture conductors are present.

The body of the container should be formed from a material that allows the body to fracture along the break path when a force is correctly applied by a user. A material that is too resilient or deformable or has a very high elasticity may not be suitable. The body may be formed from a polymer. The body is preferably formed from a material including: polystyrene, polypropylene, polyethylene terephthalate (PET), amorphous polyurethane terephthalate (APET), polyvinyl chloride (PVC), high density polyethylene (HDPE), low density polyethylene (LDPE), polylactic acid (PLA), bio material, mineral filled material, thin metal formed material, acrylonitrile butadiene styrene (ABS) or laminate.

The body may be formed by at least one of sheet thermoforming, injection moulding, compression moulding or 3D printing. In the prior art it has been difficult or impossible to create a fracturable container using 3D printing which will fracture along a break path consistently. The addition of fracture conductors along the break path may allow more consistent fracturing of containers formed by 3D printing.

The cover is preferably bonded and sealed to the flange. The cover may be bonded and sealed to the flange through any suitable means, including heating, ultrasonic welding, pressure sensitive adhesive or heat actuated adhesive.

The first and second body portions intersect at the bend. The bend includes the regions of the first and second body portions adjacent the intersection. The intersection between the first and second body portions provides at least a portion of the break path. Preferably, the intersection between the first and second body portions is the break path. At sections of the bend where no fracture conductors are present each of the first and second body portions may approach the intersection as a straight line or a curve. For example, if both the first and second body portions approach the intersection as a straight line, a cross-section of this area around the intersection would resemble a V-shape. Alternatively, if both the first and second body portions approach the intersection as a curve, a cross-section of the area around the intersection could resemble a U-shape or could show both sides curving steadily downwards to a point or may have one side creating half a U-shape and the other side steadily curving downwards to meet an outward curve of the U-shape.

According to a preferred embodiment, the intersection between the first and second body portions forms an angle of from about 20° to about 170°, and more preferably the angle is from about 45° to about 105°. The intersection between the first and second body portions is formed by the intersection between a first bend portion on the first body portion and a second bend portion on the second body portion. The angle formed between the first and second bend portions is preferably from about 20° to about 170°. More preferably, the angle is from about 45° to about 120°. An angle from about 70° to about 100° may assist in creating a consistent fracture when the body of the container is opened. More preferably the angle formed between the first and second bend portions is preferably from about 75° to about 90°. The most preferred angle for fracturing a body formed from one material may not be the same as the most preferred angle for fracturing a body formed from another material. Further, the thickness of the material used to form the body may also have an effect on the most preferred angle. The depth and overall size of the bend may additionally lead to certain angles providing a greater benefit than others.

According to an embodiment, the first and second flange portions have an increased flange width compared to sections of the flange adjacent the first and second flange portions. The flange width may be increased at the first and second flange portions due to the bend being oriented inwardly towards the cavity, such that the intersection between the first and second body portions at the flange provides the increased width.

According to another embodiment, the first and second flange portions have a flange width that is substantially the same as sections of the flange adjacent the first and second flange portions. The bend may transition from the body to the flange in a straight line in order to provide said substantially the same flange width at the first and second flange portions. The bend may transition from the body to the flange in a curve in order to provide said substantially the same flange width at the first and second flange portions. Alternatively, the bend may transition from the body to the flange at the first and second flange width portions in a combination of a straight line and a curve.

Alternatively, the flange may be decreased in width at the first and second flange portions compared to sections of the flange either side of the first and second flange portions. In another alternative embodiment, the flange width may be decreased at the first and second flange width portions compared to a section of the flange on a first side of the first and second flange portions, and increased compared to a section of the flange on a second side of the first and second flange portions. Alternatively, the flange may be the same width at the first and second flange portions as a section of the flange on a first side of the first and second flange portions, and increased or decreased compared to a section of the flange on a second side of the first and second flange portions.

The break path may have more than one fracture point. Where there is more than one fracture point, the body will fracture simultaneously or substantially simultaneously at each fracture point and the fracture propagating from each fracture point will travel towards an adjacent fracture point. If a fracture point is between two other fracture points on the break path then the fracture from that fracture point will propagate along the break path in each direction towards each of the other fracture points. If a fracture point has another fracture point in one direction along the break path and a terminus in the other direction along the break path, the fracture from that fracture point will propagate along the break path in one direction towards the other fracture point and in the other direction towards the terminus.

Preferably, at locations on the break path where no fracture conductor is present the depth of the bend will be substantially constant. In some embodiments it is possible that the depth of the bend will be substantially constant even where a fracture conductor is present.

The bend extending across the body between the first flange portion and second flange portion may extend into the cavity of the body. Alternatively, the bend extending across the body between the first flange portion and second flange portion may extend outwardly from the body away from the cavity. The bend extending outwardly means that the bend extends out of the body cavity compared to regions of the first and second body portion on either side of the bend. In a preferred embodiment, the bend extends inwardly into the cavity. The bend extending inwardly means that the bend extends into the body cavity compared to regions of the first and second body portion on either side of the bend.

In situations where the fracture conductors are formed by changes in depth of the bend, where the bend extends inwardly into the body cavity the fracture conductors also preferably extend inwardly into the body cavity. The fracture conductors may extend more deeply into the container body than sections of the bend where no fracture conductors are present. Preferably, the fracture conductors are reduced in depth compared to sections of the bend where no fracture conductors are present.

The bend may be in the form of a indent, groove or channel, which would mean the bend extends into the cavity of the container. The depth of the bend is preferably constant throughout all sections where no fracture conductors are present. Alternatively, the bend may have a depth at the sections where no fracture conductors are present that varies depending on the position on the body of the container.

The bend may be in the form of a ridge or elongate elevation in the surface, which would mean that the bend extends outwardly of the container body away from the cavity. The height of the ridge or elongate elevation is preferably constant throughout sections where no fracture conductors are present. Alternatively, the bend may have a height at the sections where no fracture conductors are present that varies from one position on the body of the container to another.

A container according to the present invention may be easily opened by a user with one hand. Depending on the size of the container and its contents a user may prefer to use two hands to open the container.

BRIEF DESCRIPTION OF THE DRAWINGS

Preferred embodiments of the invention will now be described, by way of example only, with reference to the accompanying drawings, in which.

and

FIGS. 9A to 9F show variations of the first embodiment of FIG. 1 where the flange width at the intersection between the indent and flange is varied.

DESCRIPTION OF PREFERRED EMBODIMENTS

Figure 1A:
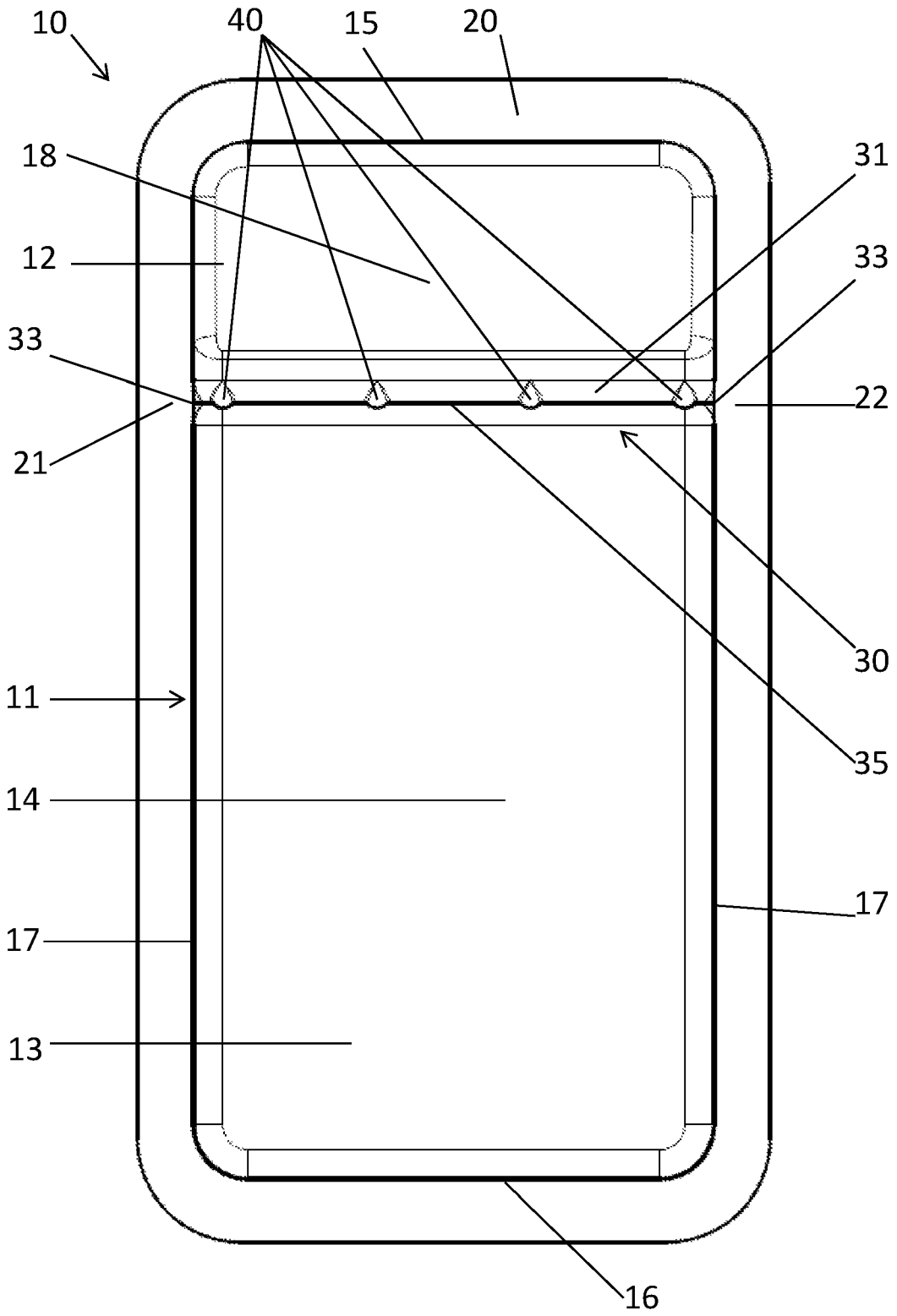
FIGS. 1A to 1D show a container according to a first embodiment.
Figure 1B:
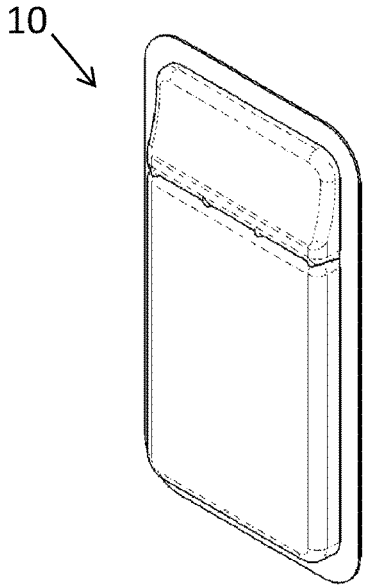
Figure 1C:
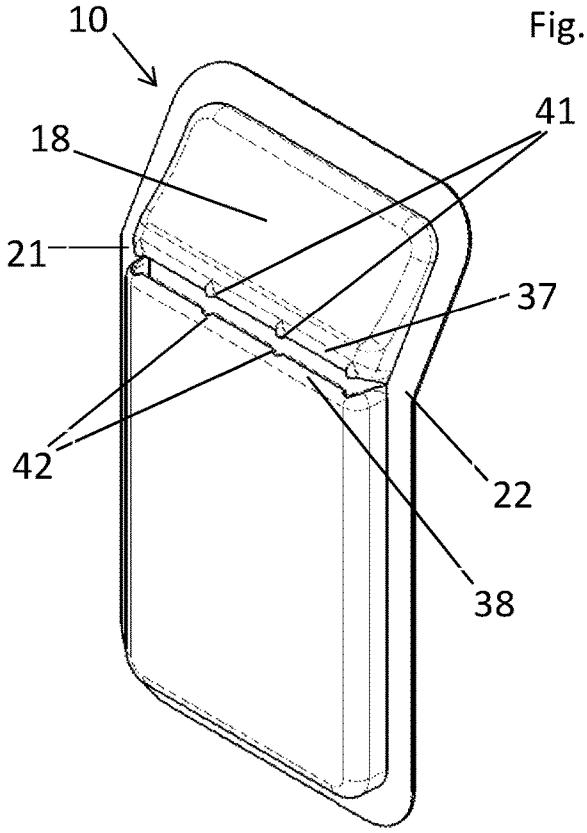
Figure 1D:
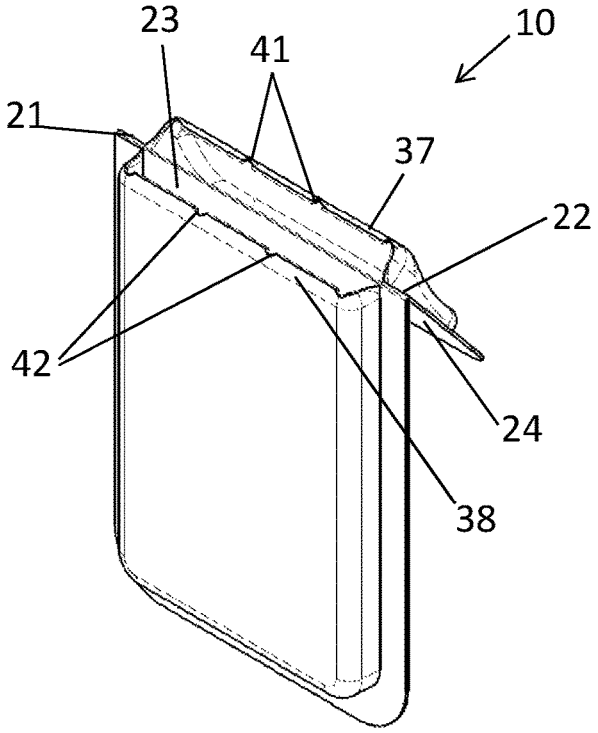

FIG. 1A shows a front view and FIG. 1B shows an isometric view of a closed container 10 according to a first embodiment. The container 10 includes a body 11 having a cavity 23 for containing one or more contents (not shown). The body 11 is substantially in the shape of a rectangular cuboid with a curvature at the corners. The body includes a front wall 14 and an upper wall 15 extending from an upper end of the front wall 14, a lower wall 16 extending from a lower end of the front wall 14 and two side walls 17 extending from each side of the front wall 14. The front, upper, lower and side walls defining the cavity 23. A flange 20 is arranged about the perimeter of the container body 11. The flange 20 is substantially parallel to a surface of the front wall of the body. The flange 20 extending around a perimeter of the body from end portions of the upper 15, lower 16 and side walls 17. A cover 24, shown in FIG. 1D, is affixed to the flange 20. The cover 24 is affixed between the sides of the flange 20 to entirely cover the rear portion of the body 11. The cover 24 is used to enclose the contents within the cavity 23 of the container 10.

A fracturable portion 30 extends across the width of the body 11. The fracturable portion 30 extends from the intersection between a first flange portion 21 and side wall 17 of the body 11 on one side and runs along said side wall 17, the front wall 14 and opposite side wall 17 until to reach the intersection between the other side wall 17 and the second flange portion 22. The fracturable portion 30 includes bend 31, which in this embodiment is an indented channel. The fracturable portion 30 substantially extends across the body 11 parallel to the upper and lower walls 15, 16 of the body 11.

The fracturable portion 30 bisects the body 11 into a first body portion 12 on one side of the bend 31 and a second body portion 13 on the other side of the bend 31. The first body portion 12 and the second body portion 13 intersect at the bend 31. The bend 31 includes the regions of the first and second body portions 12, 13 adjacent the intersection.

The fracturable portion 30 includes a break path 35. The body 11 is adapted to fracture along the break path 35 when a user holds the second body portion 13 and applies a force exceeding a predetermined level to the front wall 14 of the first body portion 12. Due to the user holding one body portion securely and applying pressure to the other body portion, a force will be applied to body portions 12, 13 on either side of the break path 35. The break path 35 is at the intersection between the first body portion 12 and the second body portion 13.

The body 11 of the container 10 is adapted to fracture initially at one or more fracture points along the break path. The initiating fracture points are the positions on the break path 35 where the most force or stress will be concentrated to cause the initial fracturing. In the embodiment of FIG. 1A, the container will likely have initiating fracture points on the break path 35 at the transition from the front wall 14 to each of the side walls 17. In other embodiments there will only be one fracture point. It is also possible that there could be embodiments with more than two fracture points. The fracture will terminate at two termini 33, with one terminus 33 at the junction between the break path 35 on each side wall 17 and the first or second flange portions 21, 22. After being initiated, the fracture will propagate along the break path 35 in either direction away from each fracture point until the fracture reaches the fracture propagating from the other fracture point or until the fracture reaches a terminus 33.

The force required to initiate the fracture is greater than that required to propagate the tear along the break path 35. As a result, the container 10 is able to withstand higher stress and maintain a sealed condition, but allows for easy opening once the container 10 has been initially fractured.

To assist in the propagation of the fracture along the break path 35 and to prevent or reduce the likelihood of the fracture deviating from the predetermined break path 35, a number of fracture conductors 40 are provided. Each fracture conductor 40 provides a localised region of increased rigidity along the break path. The increased rigidity at the fracture conductors 40 means that the body is more easily fractured at these points and after being initiated, the fracture will be drawn towards each fracture conductor 40. The fracture conductors 40 are spaced apart along the break path 35; the embodiment of FIG. 1A has four fracture conductors 40. In embodiments where the break path 35 is longer or has a more varied or difficult path than a straight line, there may need to be more fracture conductors 40 in place. The fracture conductors 40 therefore assist in guiding the fracture along the break path. The fracture will have a higher probability of following the break path 35 when the fracture conductors 40 are correctly in place, compared to when they are absent.

In the embodiment of FIG. 1, the break path 35 naturally curves between the front wall 14 of the body 10 and each side wall 17. If no fracture conductors were present, the section of the break path 35 which is positioned on the front wall 14 would be a straight line between each curved transition to the side wall sections of the break path 35.

Figure 3B:
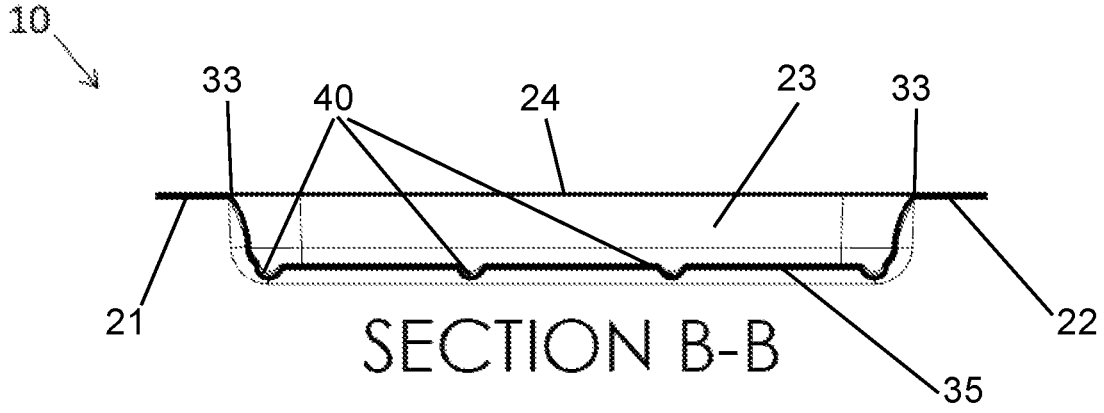
FIGS. 3A to 3F show the container according to the first embodiment of FIG. 1A in a closed position.
Figure 3C:
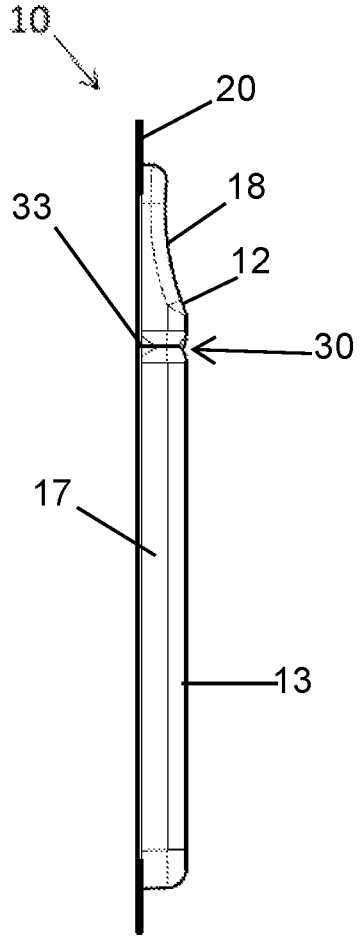
Figure 3A:
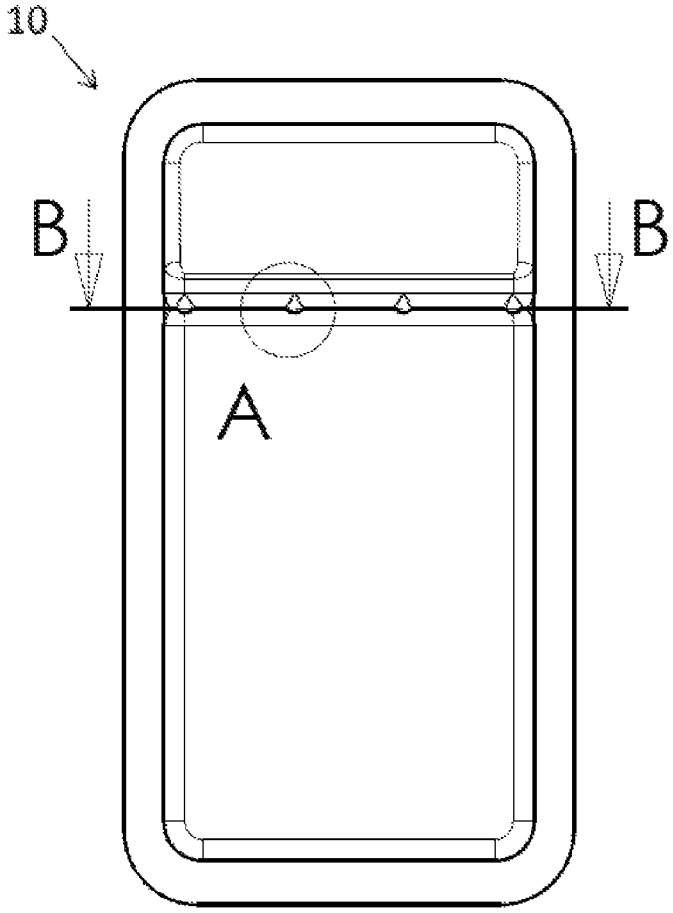

FIG. 3B shows a cross-section of the container 10 along line B in FIG. 3A. The cross-section shows that the break path 35, depicted as a thick line, extends in a non-linear path across the front wall 14 due to the placement of the conductors 40. At each conductor 40, the break path 35 deviates in direction from being a straight line to a localised curved path. The distance along the break path 35 which is encompassed by each fracture conductor 40 is preferably in the range from 0.5 mm to 5 mm. In a preferred embodiment, this distance along the break path is from 2 mm to 3 mm.

Figure 3D:
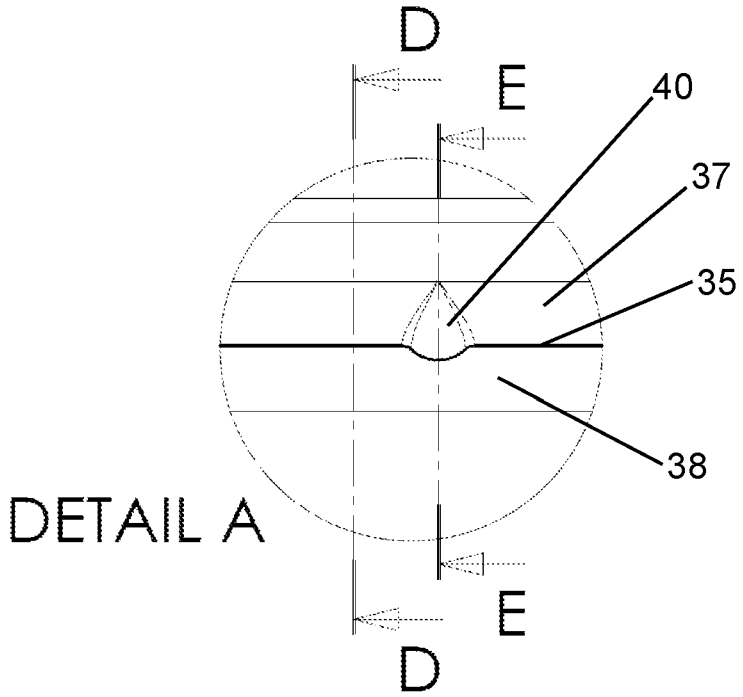

In FIG. 3D, which shows a close up of section A of FIG. 3A, the shape of a fracture conductor 40 can be seen. The overall shape of fracture conductor 40 resembles a nose. The lower surface of the fracture conductor 40 forms the part of the break path 35 which traverses the fracture conductor 40. The fracture conductor 40 remains entirely within the bounds of the bend 31, that is to say that the fracture conductor 40 does not extend outwardly beyond a surface of the front wall 14 on either side of the bend 31. If the fracture conductors 40 extended outwardly of the fracturable portion 30 beyond the plane of a front wall 14 of the first and second body portions 12, 13, it is likely that the conductors 40 would act as fracture initiators, which may be undesirable in some situations. Therefore, in a preferred embodiment the fracture conductors 40 do not extend from the bend 31 beyond a plane defined by surfaces of the first and second body portions 12, 13 on either side adjacent to the bend 31.

Figure 3E:
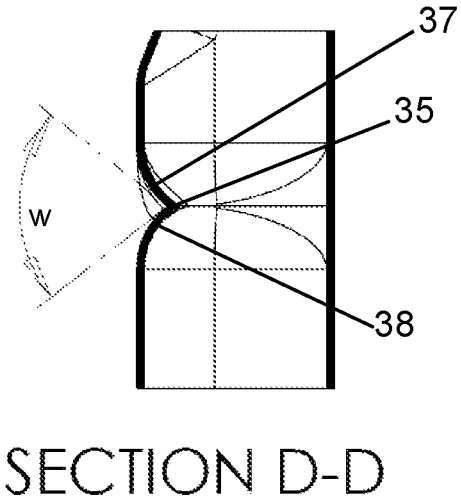
Figure 3F:
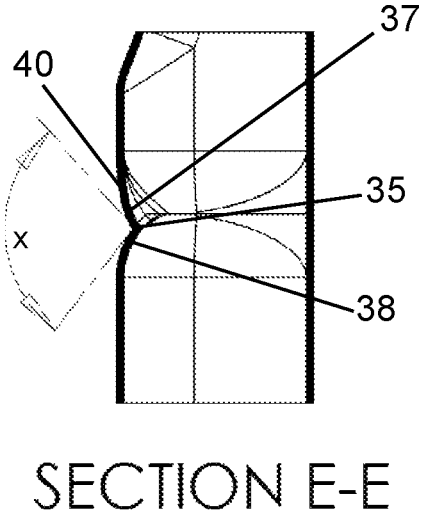

The fracture conductor 40 depicted in FIG. 3D gives a localised reduction of depth of the bend 31. The depth of the bend 31 is the distance of the lowest point of the bend 31 from the plane defined by surfaces of the first and second body portions 12, 13 on either side adjacent to the bend 31. In the embodiment of FIGS. 3A to 3F the bend 31 is an indented channel which extends into the cavity 23 and the depth is the depth to the based of the channel. In other embodiments where the bend 31 is a ridge that extends outwards from the cavity, the depth of the bend 31 is represented by the height at the peak of the ridge. FIG. 3E shows a cross-section view of the body across the fracturable portion 30 at a position where no fracture conductor 40 is present. FIG. 3F shows a cross-sectional view of the body across the fracturable portion 30 through the centre of a fracture conductor 40. The thickened line on the left of each of FIGS. 3E and 3F shows the profile of the front wall 14 across the fracturable portion 30, it is seen that the depth of the bend 31 in FIG. 3F is less than the depth of the bend 31 in FIG. 3E. In alternative embodiments, the depth of the bend 31 at the fracture conductor may be increased compared to the depth of the bend where no fracture conductor is present. In preferred embodiments, the reduction of depth of the bend 31 at the fracture conductor 40 is a reduction of 15% to 90% of the total depth of the bend 31 where no fracture conductor 40 is present.

In addition to the reduced depth at the bend 31, the fracture conductor 40 also provides a change in the shape of the bend 31. At positions on the bend 31 where no fracture conductor 40 is present the cross-sectional profile is substantially constant. Whereas, each fracture conductor 40 provides a nose shape on the profile of the bend 31. At positions where no fracture conductor 40 is present, the bend 31 has a substantially V-shaped cross-sectional profile, as seen in FIG. 3E. The V-shaped cross-section of the bend is provided by a first bend portion 37 which meets a second bend portion 38 at an intersection. The angle w between the first and section bends portions 37, 38 is around 75°. In possible alternative embodiments different angles w could be used, for example from about 20° to about 160°, preferably in from about 45° to about 120° and most preferably from about 70° to about 90°. The angle should be selected to aid fracturing of the body along the break path and optimum angles may be differ for different materials used to form the body. Angles that are too high or low may not allow the break path to fracture correctly and may lead to fractures diverging from the desired path. As shown in FIG. 3F, the angle x between the first and second bend portions 37, 38 at the fracture conductor is increased compared to angle w. The angle x is about 100°. In other embodiments the angle x at the fracture conductor could be lower than the angle w. Alternatively, the angle x could remain the same or similar to angle w, in such cases the orientation of the intersection between the first and second bend portions could be altered.

The point of intersection between the first bend portion 37 and the second bend portion 38 is on the break path 35. The first bend portion 37 is on the first body portion 12. The second bend portion 38 is on the second body portion 13. The fracture conductor 40 is positioned on one or both of the first and second bend portions 37, 38. In the embodiment shown in FIGS. 3A to 3F, the fracture conductor 40 is largely positioned on the first bend portion 37. The section of the break path 35 at the fracture conductor 40 remains at the intersections between the first and second bend portions 37, 38. In all embodiments, the break path 35 is provided by an intersection of two body portions or some other defined line such that the body of the container will follow the predefined break path.

The front wall 14 of the first body portion 12 includes an engageable surface 18, which is dimensioned or shaped to be easily pressed by one thumb or both thumbs of a user. The engageable surface 18 may include a recessed portion or inwardly curved section. FIG. 3C, which is a side view of the embodiment shown in FIGS. 1A and 3A, shows how the engageable surface 18 of the first body portion 12 curves downwards and outwards as it approaches the upper wall 15.

Figure 4B:
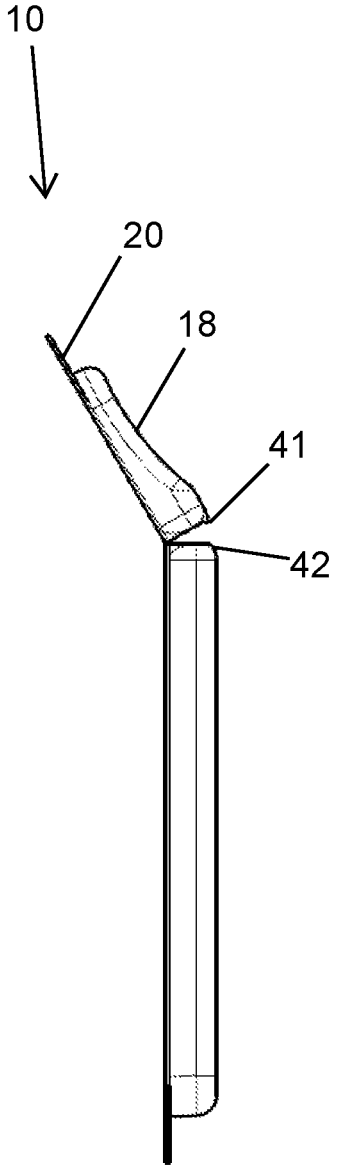
FIGS. 4A to 4E show the container according to the first embodiment of FIG. 1C in an open position.
Figure 4A:
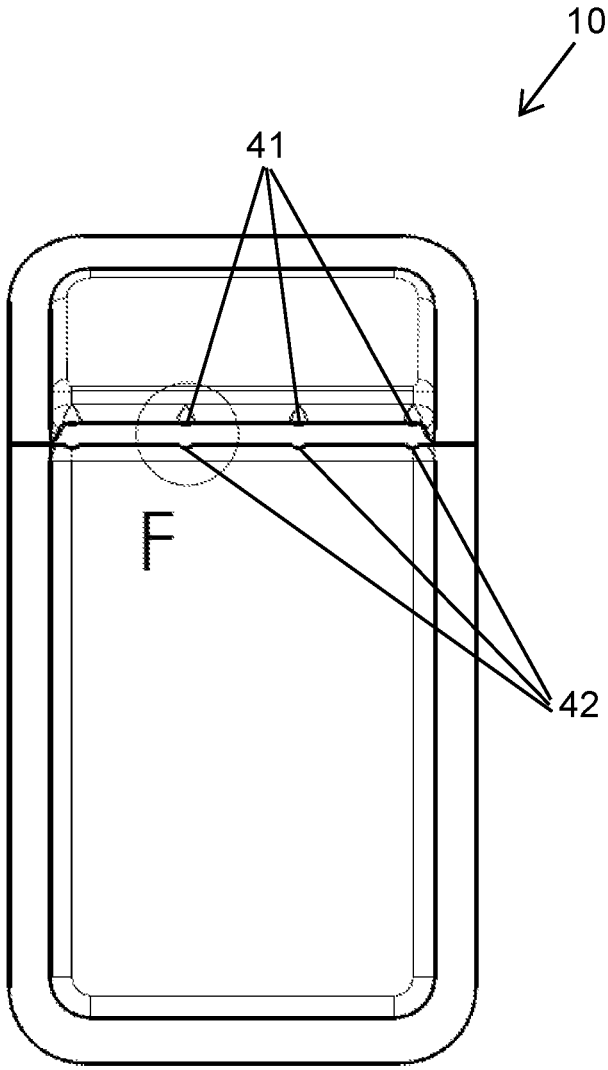
Figure 4C:
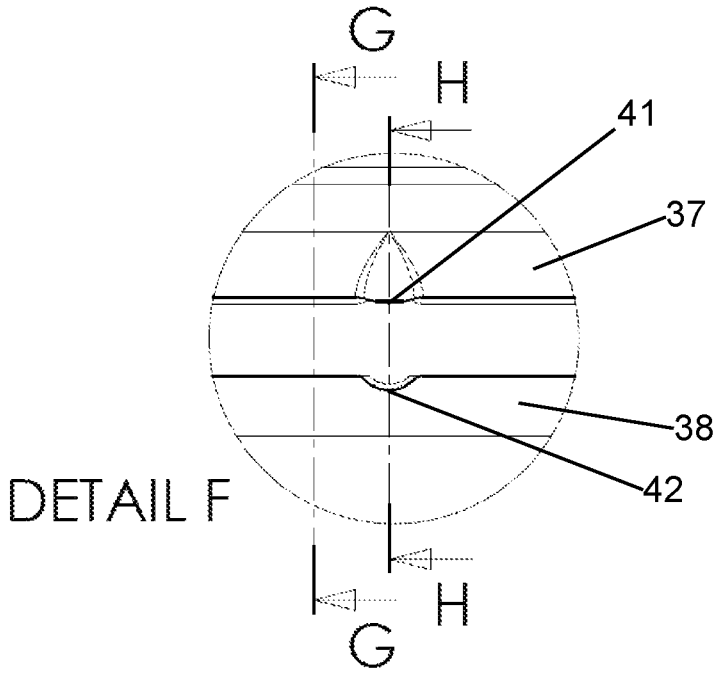
Figure 4D:
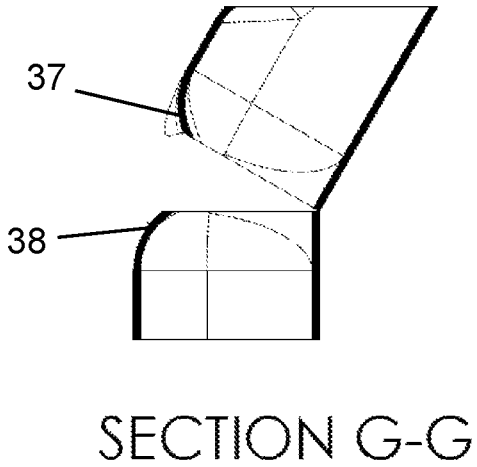
Figure 4E:
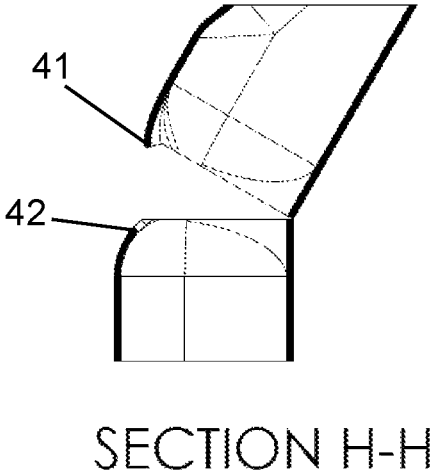

FIGS. 1C and 4A to 4E show the container 10 when the body 11 has been fractured along the break path 35 and is opened slightly. Once fractured, the first and second body portions 12, 13 are separated from one another. The opening of the container 10 is hinged at the first and second flange portions 21, 22. The container 10 may also fracture along the first and second flange portions 21, 22. Where the container fractures along the first and second flange portions, the cover 24 will hold the first and second body portions 12, 13 together and act as a hinge. Alternatively, the container may not fracture entirely along the first and second flange portions, in which case the flange would also act as a hinge. In the embodiment shown, the container is hinged in a straight horizontal line between the first and second flange portions. It is preferred that the cover 24 is formed from a flexible material that does not fracture when the body fractures. As shown in FIG. 4A, the opening along the break path 35 includes protrusions 41 on the first body portion 12 and deflections 42 on the second body portion 13 that are each due to the arrangement of the fracture conductor 40. When opened partially, as in FIG. 1C, the flange 20 may flex and act as a hinge. When opened wider, as shown in FIG. 1 D, the flange 20 has experienced a force great enough to fracture the first and second flange portions 21, 22.

Figure 2A:
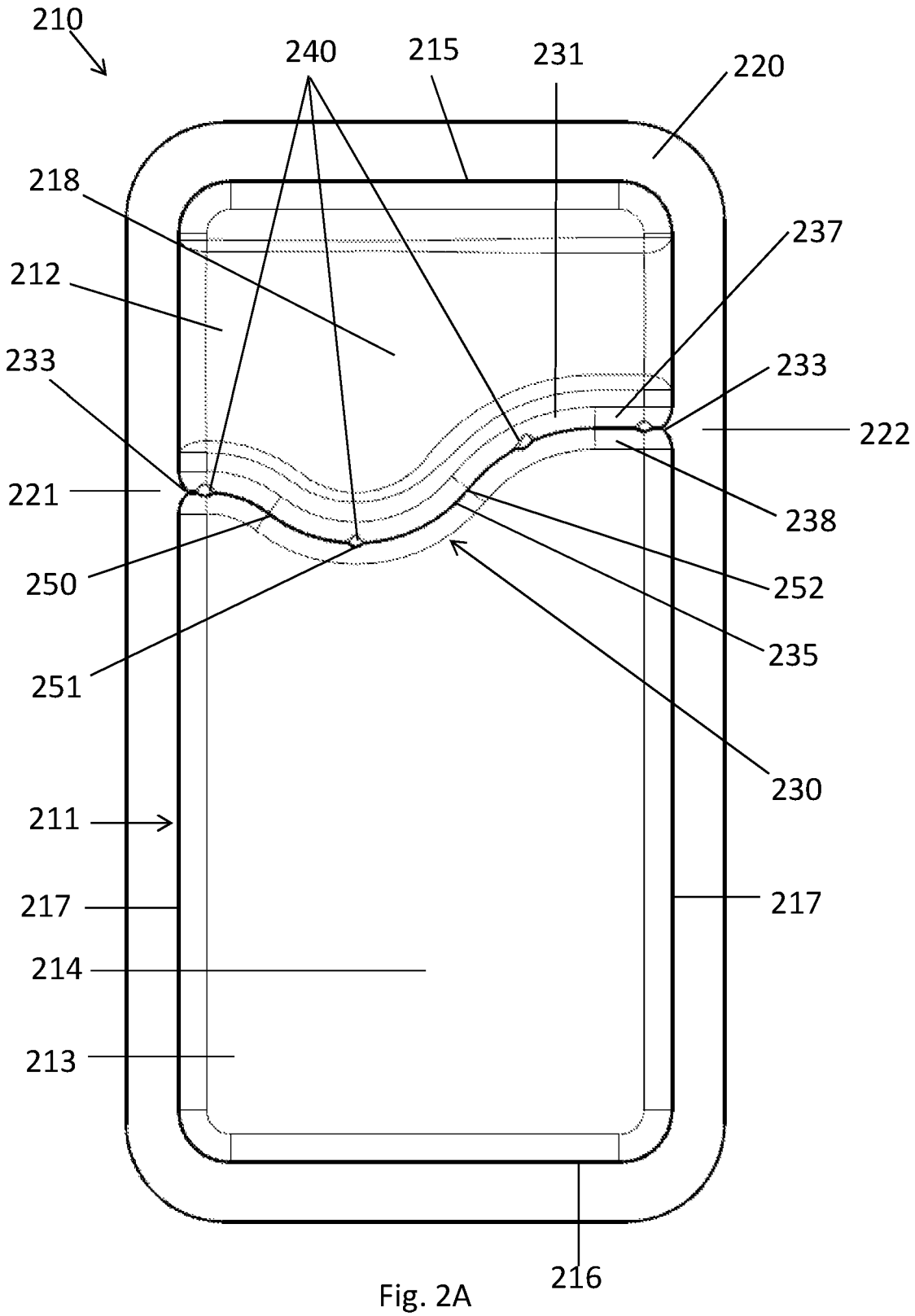
FIGS. 2A to 2D show a container according to a second embodiment.
Figure 2B:
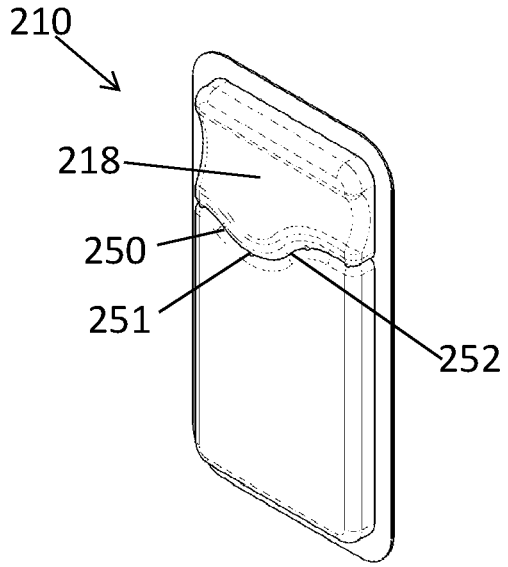
Figure 2C:
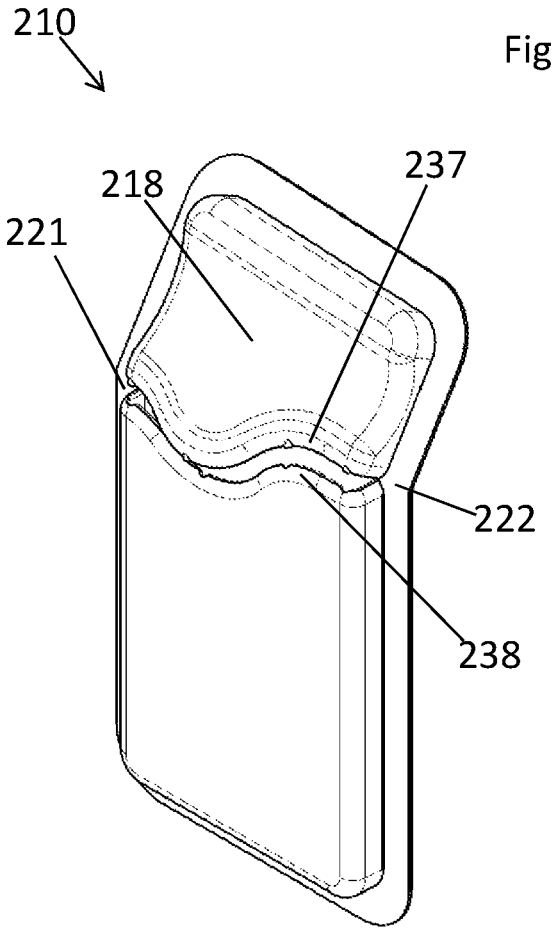
Figure 2D:
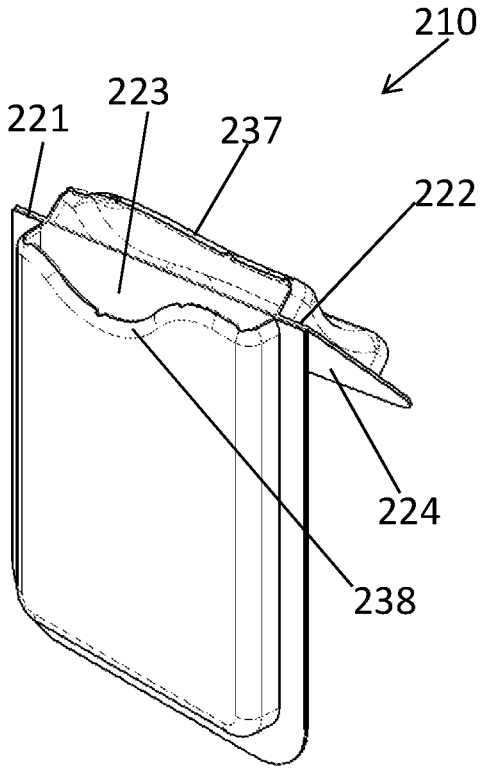

FIGS. 2A to 2D show an alternative embodiment where the overall size and shape of the container 210 remains the same as the embodiment of FIG. 1A, but where the fracturable portion 230 deviates in direction to give a path that is not parallel to the upper and lower wall 215, 216 of the body 211. The body 211 surrounds a cavity 223 which is enclosed by a cover 224. If a cross section was taken perpendicular to the break path 235, the cross sectional shape would be the same as that shown in FIG. 3E where no fracture conductor 240 is present. The fracture conductors 240 of the embodiment of FIG. 2A are smaller than those used in the embodiment of FIG. 1A, however they still provide the same localised area of increased rigidity. The fracture conductors 240 remain within the bend 231 and each fracture conductor 240 represents a localised change in shape and depth of the bend 231. The bend 231 having a first bend portion 237 on the first body portion 212 and a second bend portion 238 on the second body portion 213 which intersect at the deepest part of the bend 231 at the break path 235.

The break path 235 extends across the body 211 between each terminus 233. A first termini 233 is positioned adjacent the first flange portion 221 and a second termini 233 is positioned adjacent the second flange portion 222. In the embodiment shown in FIG. 1A, the termini 33 were perpendicularly opposite each other on opposite sides of the body. In the embodiment shown in FIG. 2A, the termini 233 are offset and not directly opposite one another, similarly the first and second flange portions 221, 222 are offset positionally with respect to one another. The first termini 233 adjacent the first flange portion 221 is positioned closer to the lower wall 216 of the body 211 than the second termini 233 adjacent the second flange portion 222.

The break path 235 extends along each side wall 217 substantially perpendicularly to the plane of the flange 220. The break path 235 transitions gradually in a curve between the side walls 217 and the front wall 214. From the left side of the front wall 214 of the body 211 and travelling to the right as shown in FIG. 2A, the break path 235 curves downwardly towards the lower wall 216, passes an inflection point 250 then reaches a vertex 251 and curves upwardly past another inflection point 252 and levels out to reach the right side of the front wall 214 in a direction substantially perpendicular to the side wall 217.

The fracture conductors 240 are spaced apart along the break path 235 and positioned to assist in guiding a fracture along the break path 235 when the container 210 is opened. Four fracture conductors 240 are provided, with one on either side of the front wall 214 of the body 211 in proximity to the transition of the break path 235 from the front wall 214 to each side wall 217. Another fracture conductor 240 is positioned at the vertex 251. The other fracture conductor 240 is positioned in a transition point on the curve of the break path 235. Preferably, where the break paths are non-linear, the fracture conductors should be positioned such that they assist in guiding a fracture along the break path without veering off at a tangent, which is a greater possibility when fracture conductors are not used.

Similarly, to the previously discussed embodiment, the container 210 includes an engageable surface 218 on the first body portion 212 to be engaged by a thumb or thumbs of a user opening the container 210. Due to the offset between the positions of the termini 233 and first and second flange portions 221, 222, when the body 211 is fractured and the container 210 is opened, the first and second body portions 212, 213 will be hinged at an oblique angle. The opening action of the container 210 is otherwise similar to the previously discussed embodiment. When opened, the first and second bend portions 237, 238 of the first and second body portions 212, 213 display the non-linear shape of the break path 235. The fractured body portions also show protrusions or deflections reflecting the positioning of the fracture conductors 240.

Figure 5A:
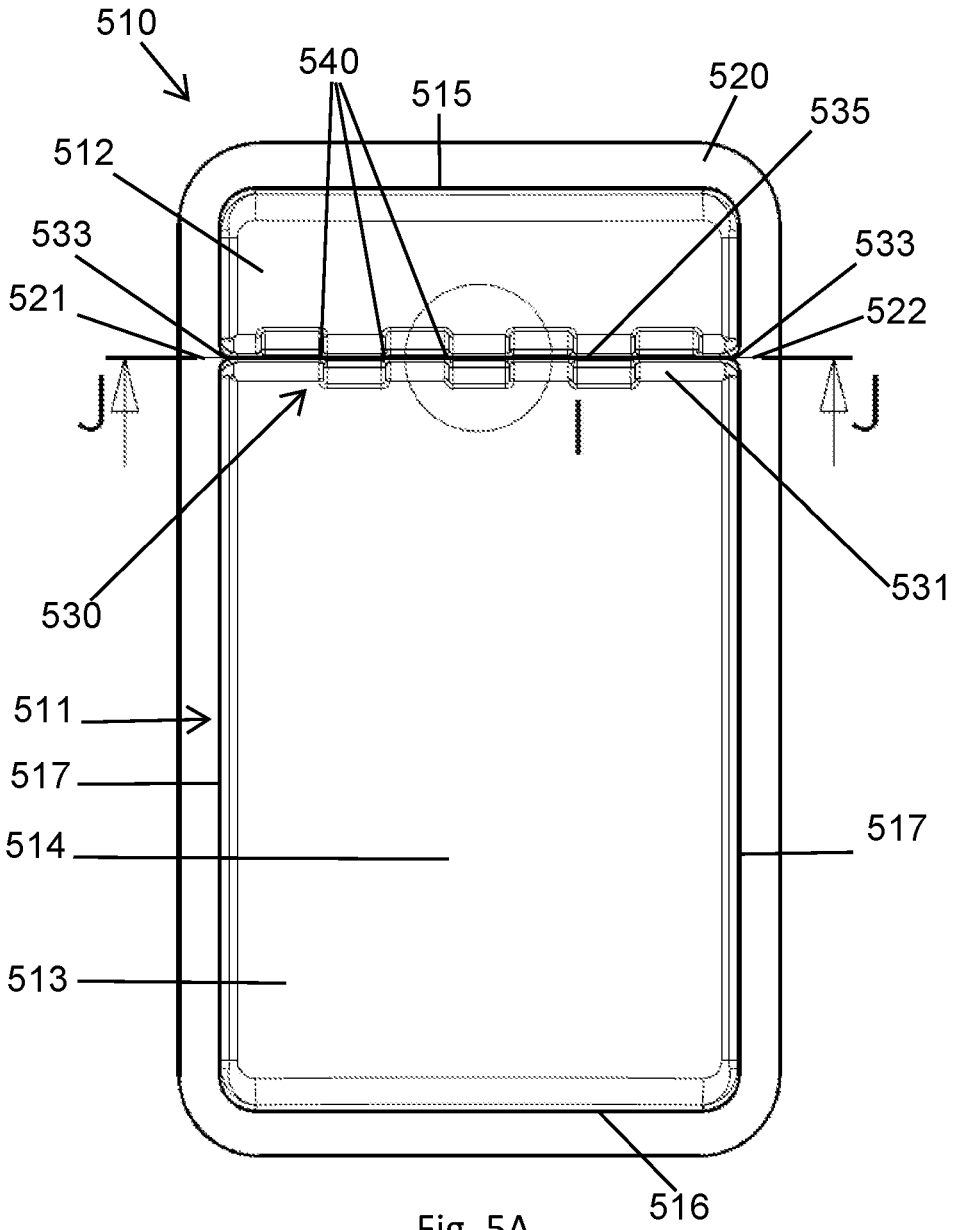
FIGS. 5A to 5G show a container according to a third embodiment.
Figure 5C:
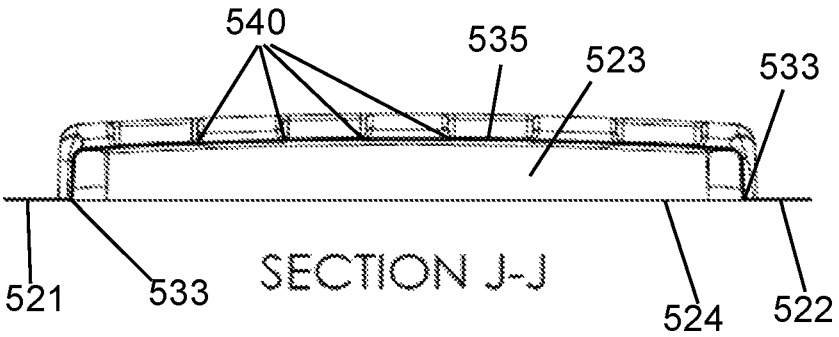
Figure 5B:
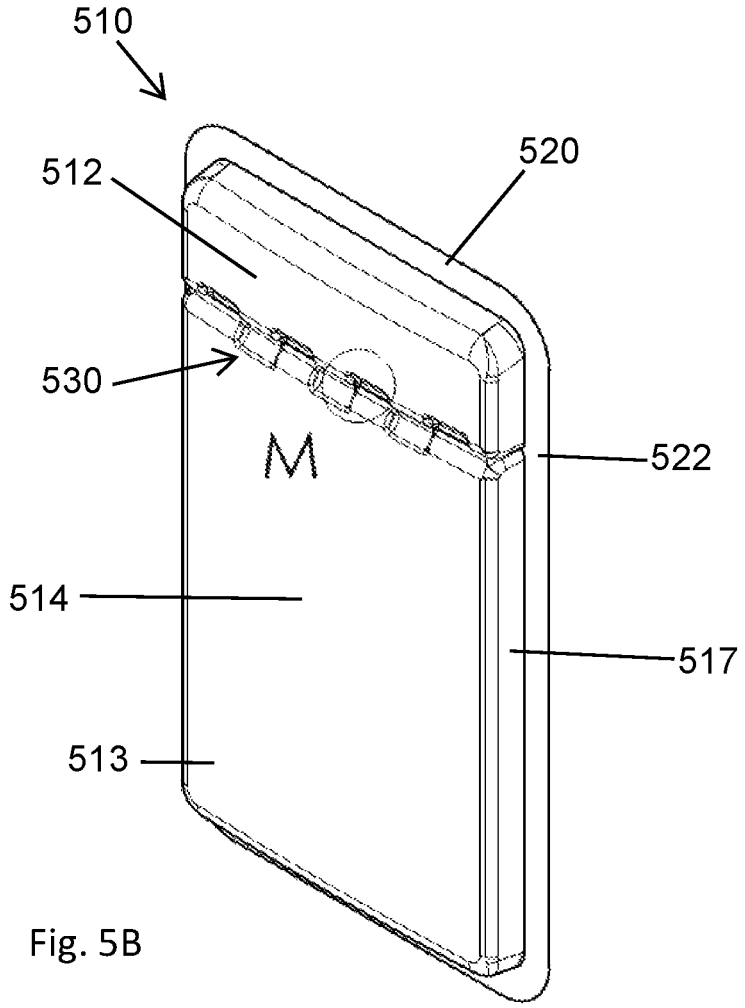
Figure 5D:
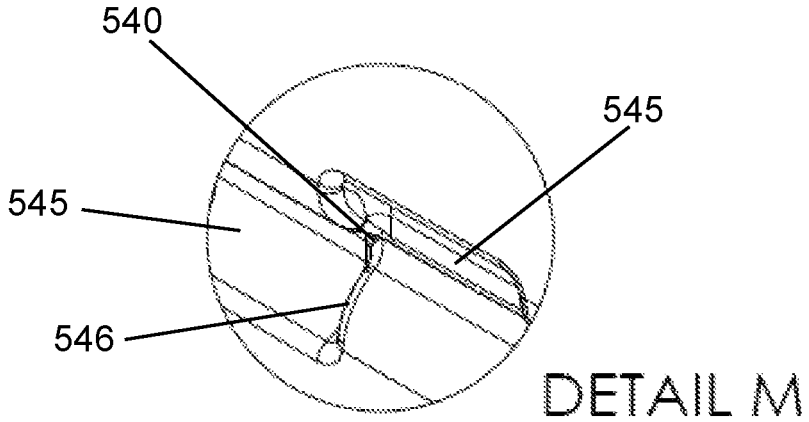
Figure 5E:
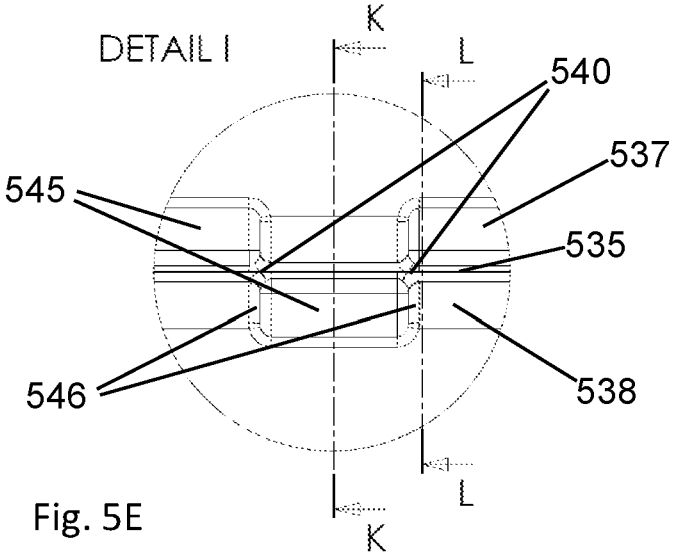

FIGS. 5A to 5G show an embodiment where the break path 535 is adapted to fracture along a path substantially within a single plane defined by each terminus 533 and any other point on the break path 535. The plane of the break path 535 is substantially parallel to a plane of each of the upper and lower walls of the body 515, 516. This is shown in FIGS. 5A, 5C and 5E which show the break path 535 as being within the single plane.

The container 510 is of similar overall shape to that of the previous embodiments. The container 510 includes a body 511 with first and second body portions 512, 513. The body 511 having a front wall 514, upper wall 515, lower wall 516 and side walls 517. The front wall 514 has a curved cross sectional shape, as seen in FIG. 5C, with the centre between the side walls 517 having the greatest depth from the cover 524. The flange 520 is provided around the perimeter of the upper, lower and side walls, with a cavity 523 defined within the body. Cover 524 is affixed and sealed over the flange 520 to enclose one or more contents (not shown) within the cavity 523.

The fracturable portion 530 extends across the width of the body from the intersection of the side wall 517 and a first flange portion 521 on one side, across the front wall 514 and to the intersection between the other side wall 517 and the second flange portion 522 on the other side of the body 510. The fracturable portion 530 extends across the body 511 substantially parallel the upper and lower walls 515, 516 of the body 511. The fracturable portion 530 includes bend 531, which in this embodiment is an indented channel that includes alternating recesses 545 on either side of the break path 535. The fracturable portion 530 bisects the body 511 into a first body portion 512 on one side of the bend 531 and a second body portion 513 on the other side of the bend 531. The first body portion 512 and the second body portion 513 intersect at the break path 535. A first bend portion 537 is part of the first body portion 512 and a second bend portion 538 is part of the second body portion 513. The recesses 545 are positioned on the bend such that they alternate between the first bend portion 537 and the second bend portion 538.

The depth of the bend 531 at the break path 535 remains substantially constant across the front wall 514 of the body 511, as shown by FIG. 5C. The depth of the bend 531 at the break path 535 on the side walls 517 of the body 511 is reduced compared to the depth of the bend 531 along the front wall 514.

Figure 5F:
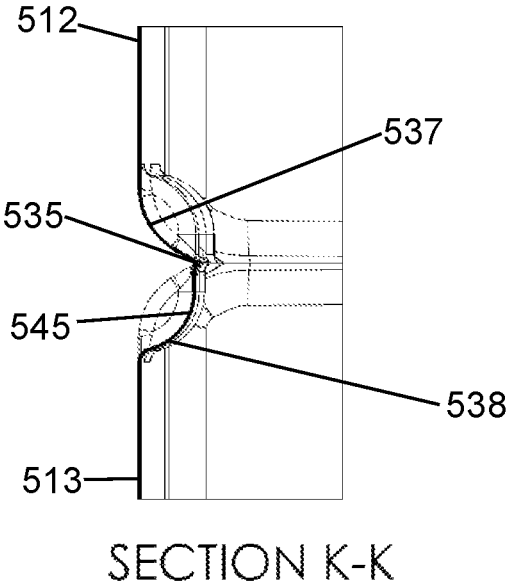
Figure 5G:
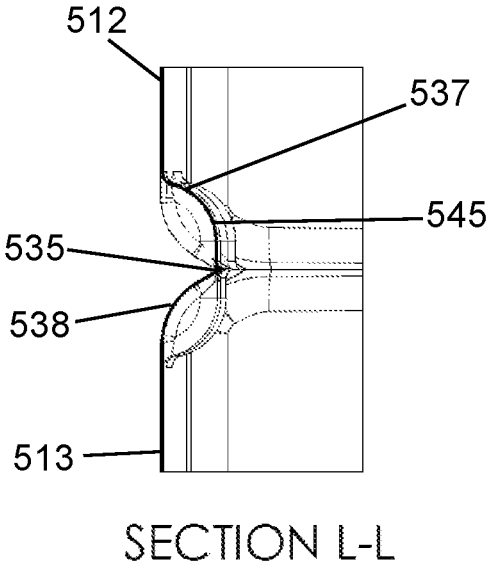

FIG. 5E shows an enlargement of detail I of FIG. 5A. FIG. 5F shows a cross-section along line K of FIG. 5E. FIG. 5G shows a cross-section along line L of FIG. 5E. The thickened line in FIGS. 5F and 5G show the contour of the front wall 514 of the body 511 along lines K and L, respectively. A recess 545 is provided on the first bend portion 537 and no recess is provided on the second bend portion 538 in FIG. 5G. Whereas, a recess 545 is provided on the second bend portion 538 and no recess is provided on the first bend portion 537 in FIG. 5F. The sections of the first and second bend portion 537, 538 where a recess 545 is present have a curved cross-sectional profile that is curved downwards and gradually outwards towards the opposite body portion. This curve substantially flattens out as it approaches the opposite bend portion until it reaches the break path 535. The sections of the first and second bend portions 537, 538 where no recess is present have an oppositely curved cross-sectional profile that is curved outwards and gradually downwards. This opposite curve has an increased gradient as it approaches the break path 535, which is the intersection with the other bend portion. These curved profiles are shown in FIGS. 5F and 5G.

Each recessed region 545 of the first or second bend portions 537, 538 includes a gradual transition 546 partially around its perimeter. The gradual transition 546 is a curved region between the depth of the recess 545 and the height of the non-recessed portions surrounding the recess 545.

The fracture conductors 540 of the embodiment of FIGS. 5A to 5G are not individual alterations in the depth of the bend 531 as with previously discussed embodiments and are instead located at the intersections of the recessed regions 545 of the bends 531. The recesses 545 are positioned such that a corner of a recess 545 in the first or second bend portion 537, 538 substantially coincides with a corner of a recess 545 on the opposite bend portion. These positions where the corners of the recesses 545 substantially intersect are on the break path 535 and have a higher rigidity than other points on the break path 535. These regions of localised increase in rigidity are the fracture conductors 540.

When a user holds the package and applies force greater than a predetermined level to the first and second body portions 512, 513 on either side of the fracturable portion 530, a fracture will initiate at an initiating fracture point. It is possible that there may be more than one initiating fracture point. The fracture point is the position or positions on the break path 535 where stress is concentrated when the force is applied to each of the first and second body portions 512, 513. A fracture will initiate at each fracture point and propagate in each direction along the break path 535 towards each terminus 533. The fracture conductors 540 including localised regions of increased rigidity mean that the body 511 will fracture more easily at desired positions. The fracture conductors 540 therefore aid in guiding a fracture to propagate in the desired direction along the break path 535.

Figure 6A:
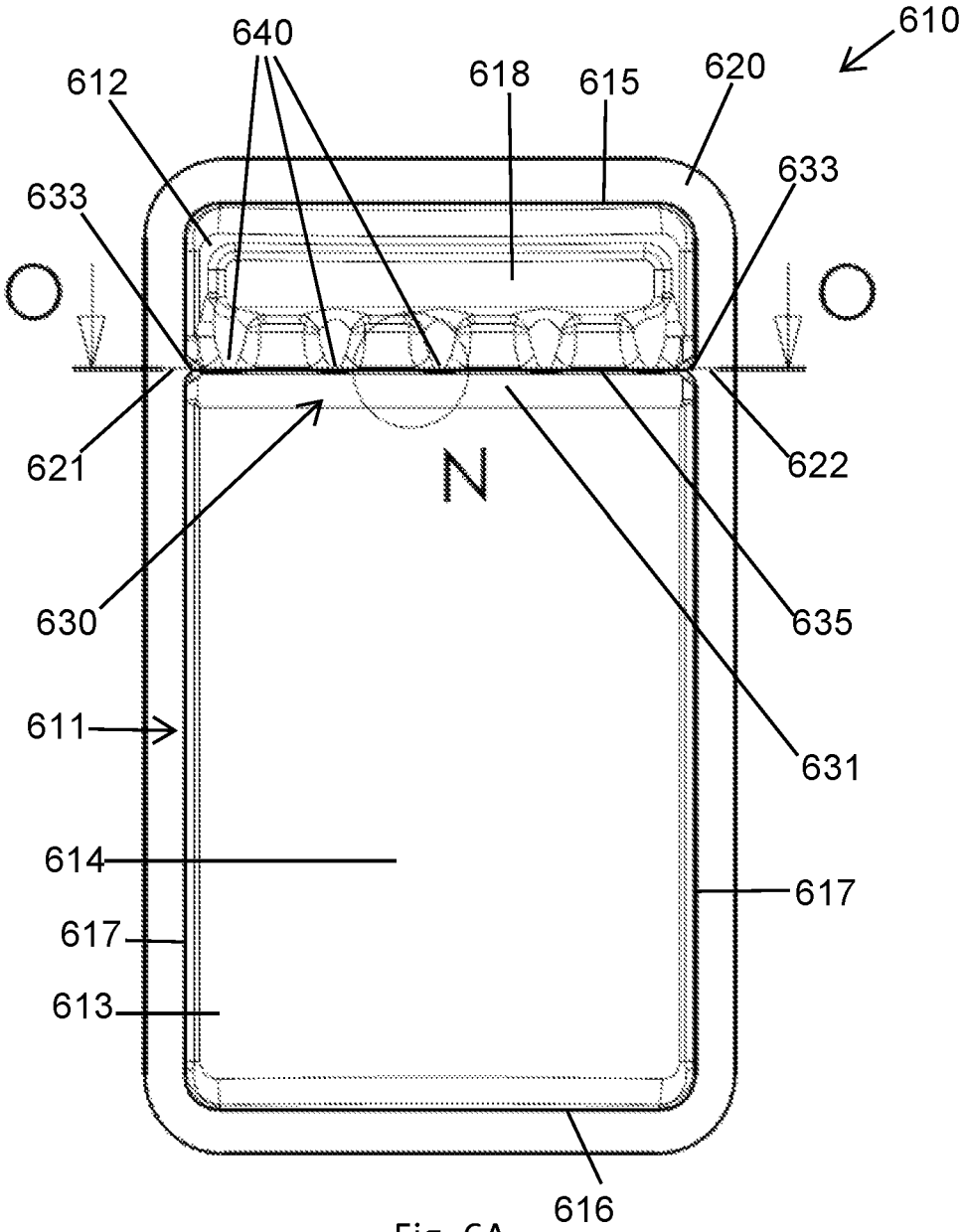
FIGS. 6A to 6E show a container according to a fourth embodiment.
Figure 6B:
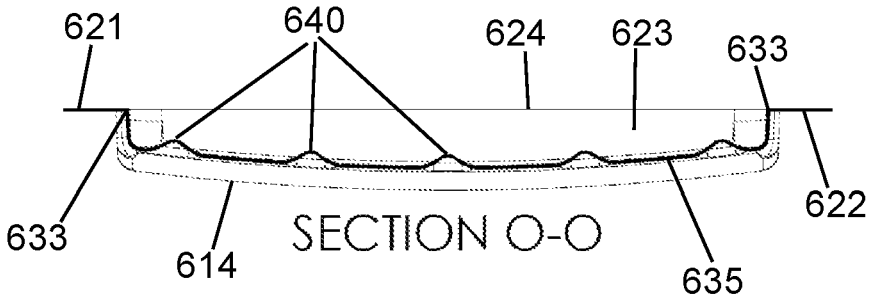

FIGS. 6A to 6E show another embodiment where the fracture conductors 640 provide a localised increase in depth of the bend 631 and break path 635. Particularly, FIG. 6B shows the break path 635 and how the depth below the front wall 614 increases at each fracture conductor 640. In preferred embodiments, the increase of depth of the bend 631 at the fracture conductor 640 is an increase of 15% to 90% of the total depth of the bend 631 where no fracture conductor 640 is present. The container 610 is of similar overall shape to that of the previous embodiments. The container 610 includes a body 611 with first and second body portions 612, 613. The body 611 having a front wall 614, upper wall 615, lower wall 616 and side walls 617. The flange 620 is provided around the perimeter of the upper, lower and side walls, with a cavity 623 defined within the body. Cover 624 is affixed and sealed over the flange 620 to enclose one or more contents (not shown) within the cavity 623.

The fracturable portion 630 extends across the width of the body from the intersection of the side wall 617 and a first flange portion 621 on one side, across the front wall 614 and to the intersection between the other side wall 617 and the second flange portion 622 on the other side of the body 611. The fracturable portion 630 extends across the body 611 substantially parallel the upper and lower walls 615, 616 of the body 611. The fracturable portion 630 includes bend 631. The bend 631 is a channel that runs across the body 611 from one side wall 617 to the other side wall 617. Break path 635 is at the lowest points on the bend 631 at any given position along the length of the bend 631.

Figure 6C:
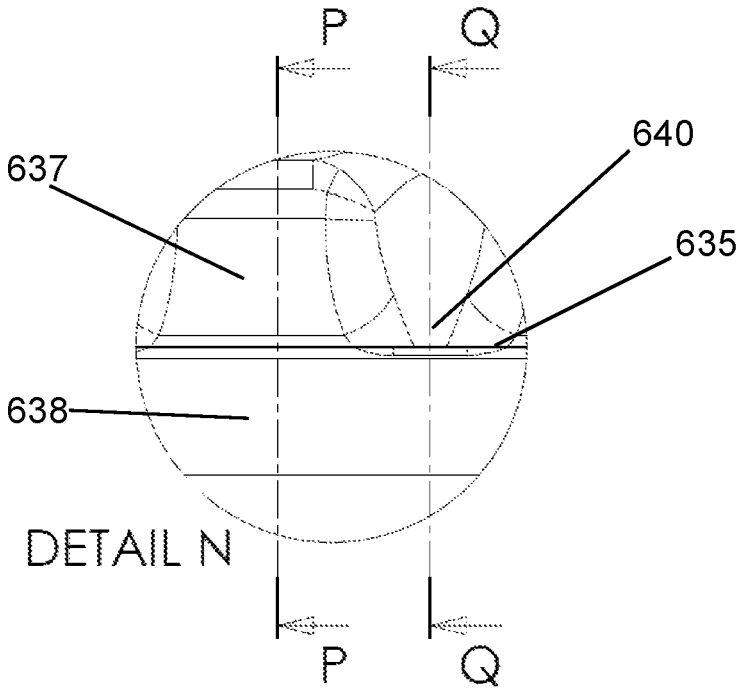
Figure 6D:
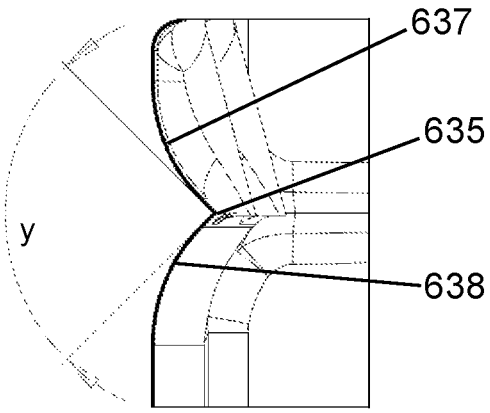
Figure 6E:
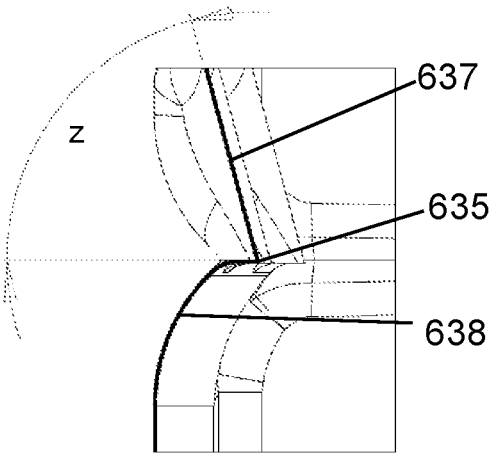

FIG. 6C shows an enlargement of detail N of FIG. 6A. FIG. 6D is a cross-section taken along line P of FIG. 6C. FIG. 6E is a cross-section taken along line Q of FIG. 6C. FIG. 6D shows a cross-section across the fracturable portion 630 where no fracture conductor 640 is present, the first and second bend portions 637, 638 each approaching the intersection of the break path 635 at a substantially equal gradient. The intersection between the first and second bend portions 637, 638 forms angle y. Preferably, angle y is between 45° and 105°, and more preferably between 70° and 95°. The most beneficial angle y may be influenced by the material from which the body of the container is formed.

As shown in FIG. 6E, where a fracture conductor 640 is present the second bend portion 638 approaches in an identical manner as in FIG. 6D, but when it reaches the same end point it transitions at an angle to travel directly towards the deeper break path 635 perpendicularly to the plane of the cover 624. The first bend portion 637 at the fracture conductor 640 is angled in a straight line towards the break path 635 at the depth of the bend 631. The intersection between the first and second bend portions 637, 638 adjacent the break path 635 forms angle z. The angle z is substantially similar to angle y, although the orientation of angle z is different from angle y, as is visible from FIGS. 6D and 6E.

The container 610 is opened in a similar manner to the previous embodiments by being held at the second body portion 613 by a user who applies a force greater than a predetermined level to an engageable surface 618 of the first body portion 612. The body 611 of the container 610 will fracture initially at one or more fracture points on the break path 635 where the stress of the force applied will be focused most greatly. A fracture will then propagate along the break path 635 from each fracture point in each direction towards each terminus 633.

Figure 7A:
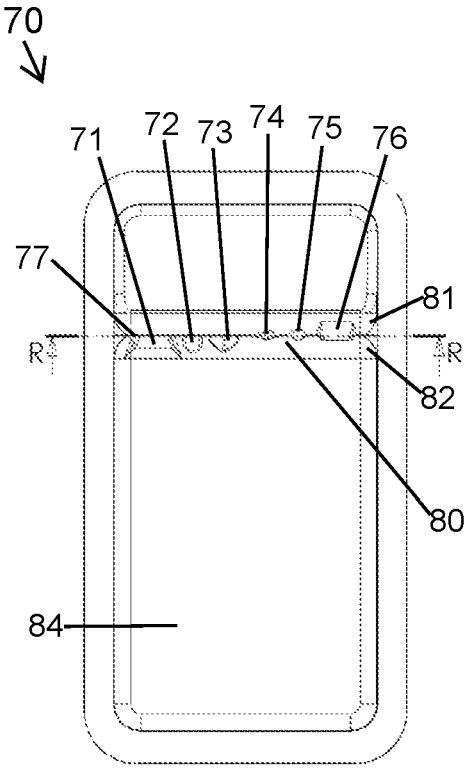
FIGS. 7A to 7D show a container according to a fifth embodiment.
Figure 7C:
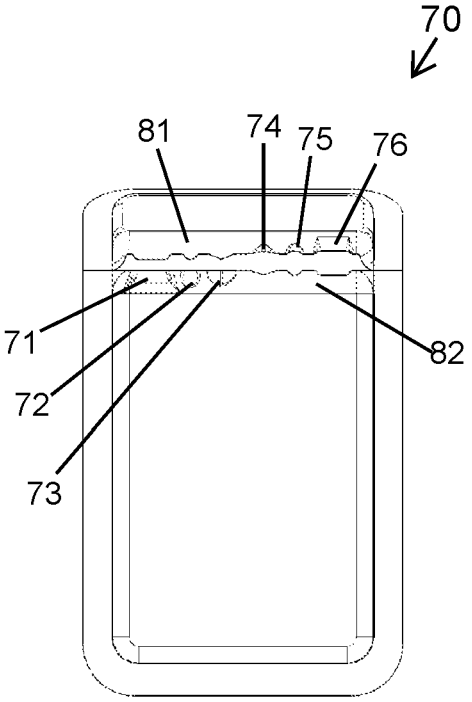
Figure 7B:
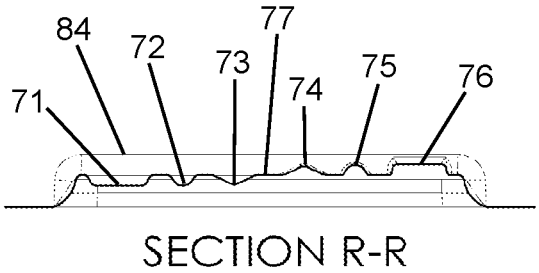

FIGS. 7A to 7D demonstrate the possible variations in shape and depth of the bend 80 that can be provided by variations in the fracture conductors 71, 72, 73, 74, 75, 76. Fracture conductors 71, 72, 73 are provided substantially on the second bend portion 82. Each fracture conductor 71, 72, 73 provides a localised increase in the depth of the bend 80 below the front wall 84, as shown in FIG. 7B. Fracture conductors 74, 75, 76 are each provided substantially on the first bend portions 81. Each fracture conductor 74, 75, 76 provides a localised decrease in the depth of the bend 80 below the front wall 84, as shown in FIG. 7B. The break path 77 follows the lowest point at the base of the bend 80. The container 70 will fracture along the break path 77 when being opened in a manner similar to described in relation to previous embodiments.

Figure 7D:
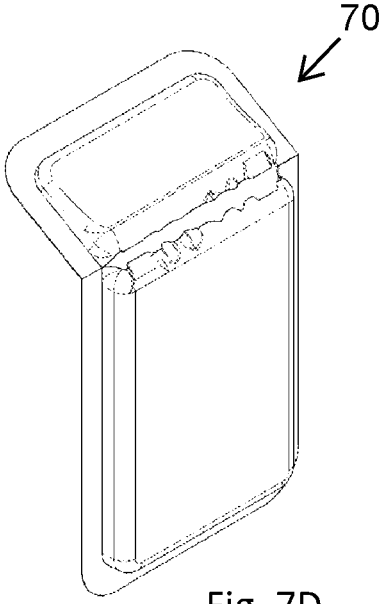

Fracture conductors 71, 76 provide long conductors which travel along an extended length of the bend compared to the other displayed fracture conductors 72, 73, 74, 75. Fracture conductors 72, 75 provide curve shaped conductors which provide a parabolic increase or decrease in the depth of the bend 80, respectively, as seen in FIG. 7B. Fracture conductors 73, 74 provide conductors that taper down or up to a lowest or highest point on the bend 80 in straight lines from each side of the break path, as shown in FIG. 7B. FIGS. 7C and 7D show the container after is has been opened by fracturing along the break path 77.

Figure 8A:
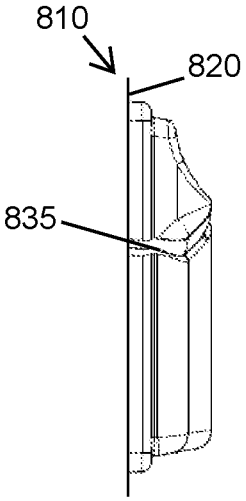
FIGS. 8A to 8I show a container according to a sixth embodiment.
Figure 8B:
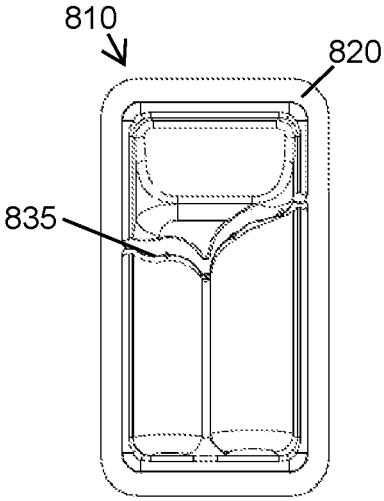
Figure 8C:
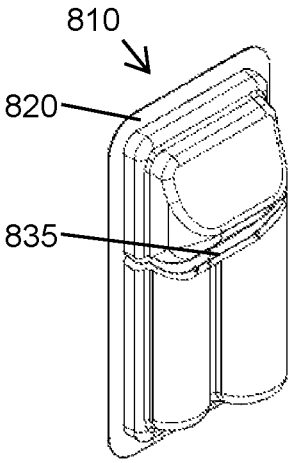
Figure 8D:
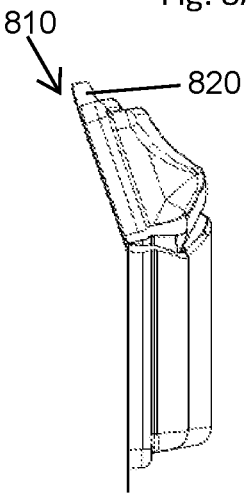
Figure 8E:
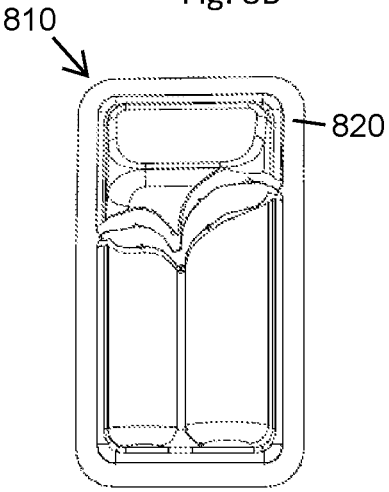
Figure 8F:
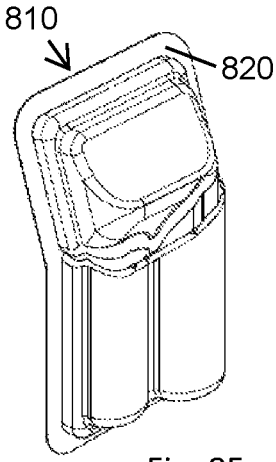
Figure 8G:
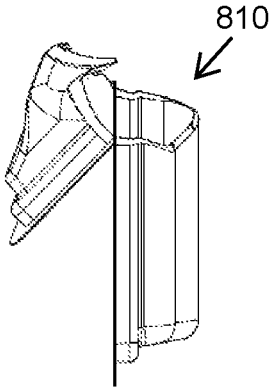
Figure 8H:
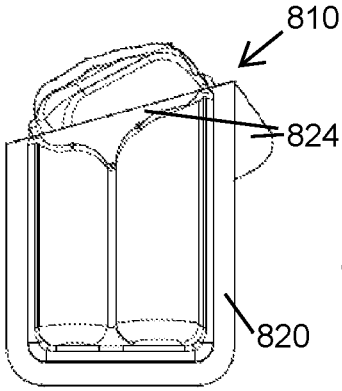
Figure 8I:
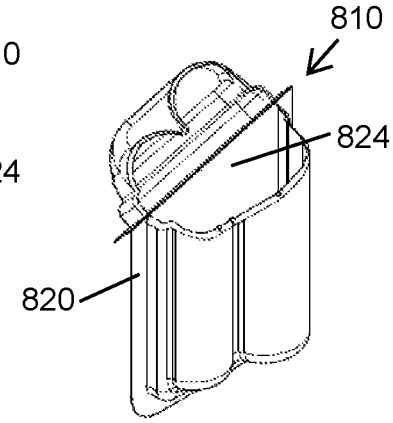

FIGS. 8A to 8I show an embodiment where the container 810 is not symmetrical and provides a complex three dimensional shape. The break path 835 follows a deviating path through three dimensions. FIGS. 8A to 8C show side, front and isometric views of the container 810 when closed. FIGS. 8D to 8F show side, front and isometric views of the container 810 when partially opened such that the flange 820 on either side of the break path 835 has not fractured. FIGS. 8G to 8I show side, front and isometric views of the container when the container 810 is opened more widely and the flange 820 has also fractured such that the container 810 hinges about the cover 824.

Figure 9A:
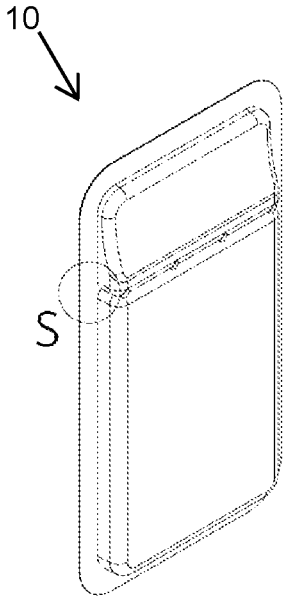
Figure 9C:
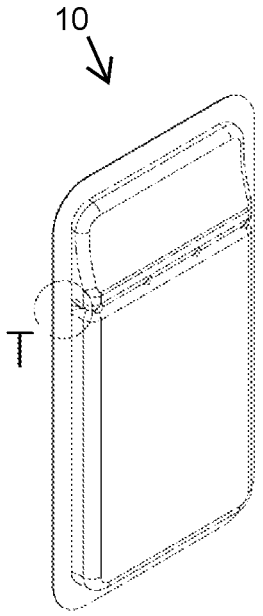
Figure 9E:
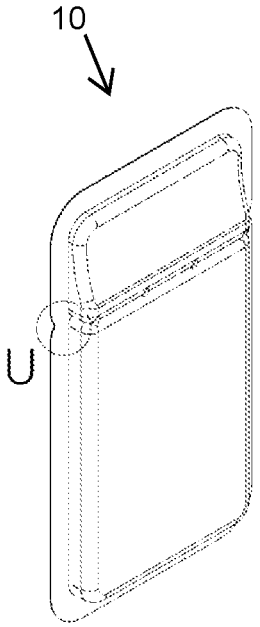
Figure 9B:
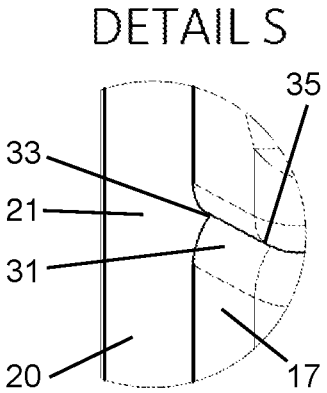

FIGS. 9A and 9B show a variation of the embodiment of FIG. 1A where the first flange portion 21 is wider than portions of the flange 20 on either side of the first flange portion 21. This embodiment could equally be applied to the second flange portion 22. The increase in flange width at the first flange portion 21 is caused by the outer edge of the flange 20 being a straight line and the inner edge of the flange 20 which meets the body following the contour of the bend 31 at the first flange portion 21. The terminus 33 of the break path 35 provides the position on the first flange portion 21 where the flange width is widest. An increased flange width is also shown in the embodiments of FIGS. 5A to 5G and 6A to 6E.

Figure 9D:
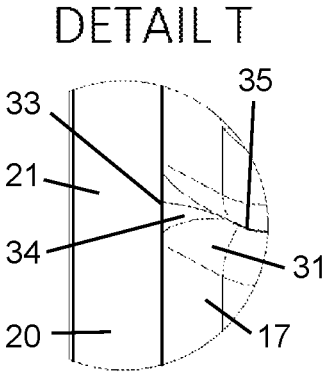

FIGS. 9C and 9D show the first flange portion in the same embodiment as FIG. 1A. The flange width at the first flange portion 21 is substantially the same as portions of the flange 20 on either side of the first flange portion 21. This embodiment is equally applicable to the second flange portion 22. The substantially constant flange width is provided by a transitional section 34 of the bend 31 as it approaches the intersection between the body and the flange. The transitional section 34 may be a flat section that tapers towards the flange 20 as a straight line. Alternatively, the transitional section 34 may be a curved transition towards the flange 20. The transitional section 34 represents a reduction in the depth of the bend 31 as it approaches the flange 20. At the flange 20, the bend 31 includes the terminus 33 of the break path 35 which has no depth below the surface of portions of the side wall 17 on either side of the bend 31. A substantially constant flange width is also shown in the embodiment of FIGS. 7A to 7D.

Figure 9F:
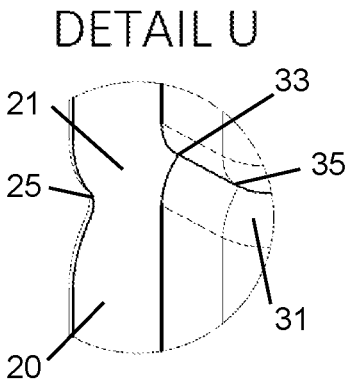

FIGS. 9E and 9F show a variation of the embodiment of FIG. 1 A where the flange width remains substantially constant across the first flange portion 21 as with portions of the flange 20 on either side of the first flange portion 21. The substantially constant flange width is provided by the cut out section 25, which substantially follows the contour of the inner flange edge at the intersection with the bend 31 on the side wall 17. In alternative embodiments the cut out section 25 could provide a decrease in the flange width compared to sections of the flange on either side of the first flange portion 21, if the cut out section 25 was increased in distance into the first flange portion 21. Alternatively, a decreased flange width at the first flange portion 21 could be provided with a cut out section 25 shown in FIGS. 9E and 9F in combination with the transitional section 34 of the bend 31 shown in FIGS. 9C and 9D. These embodiments could equally be applied to the second flange portion 22. In alternative embodiments where the bend extends outwardly of the body away from the cavity, the flange width may be decreased at the first and second flange portions due to the protruding nature of the bend towards the outer edge of the flange as the bend meets the first flange portion.

In any of the embodiments, the body and flange are preferably formed as a single member. The body and flange can be formed by an appropriate manufacturing process, in particular one of sheet thermoforming, injection moulding, compression moulding or 3D printing. Preferably, the body and flange are formed from a material including one of or a combination of more than one of: polystyrene, polypropylene, polyethylene terephthalate (PET), polyvinyl chloride (PVC), amorphous polyethylene terephthalate (APET), high density polyethylene (HDPE), low density polyethylene (LDPE), polylactic acid (PLA), bio material, mineral filled material, thin metal formed material, acrylonitrile butadiene styrene (ABS) or laminate. Particularly, embodiments of the container may have a body and flange formed from a polystyrene material or a polypropylene material with a thickness of around 100 μm to 1000 μm, more preferably around 300 μm to 900 μm and more preferably in the region of 400 μm to 750 μm. The material used and the thickness thereof should be selected to ensure that a container fracturable along the break path is formed. The use of fracture conductors means that materials and thicknesses thereof that were not previously able to provide consistently fracturing containers may now achieve the goal of providing a container which will consistently fracture along a predefined break path.

When the body and flange are formed from one of the above methods, the contents can be inserted or deposited into the cavity. The cover must then be applied over the outer surfaces of the flange to enclose the contents. In some circumstances, such as where the contents is a liquid or other flowable substance or is perishable, it is desirable that the body, flange and cover form an airtight seal around the contents. The cover is preferably bonded and sealed to the flange through heating, ultrasonic welding, pressure sensitive adhesive, heat actuated adhesive or another type of adhesive. Although, any other known manner for bonding and sealing the cover to the flange may be used.

In alternative embodiments, the localised regions of changed rigidity are not created through geometrical features of depth or shape of the fracture conductors. In some embodiments, the fracture conductors may include localised regions of increased rigidity in the form of crystallisation of the material of the body at the spaced apart fracture conductors. In such embodiments, the body of the container is formed from a crystallisable material. For example, a polymer material such as polyethylene terephthalate (PET) and amorphous polyurethane terephthalate (APET) could be used. Alternative crystallisable polymer materials could also be used, including polypropylene and/or other polymers which exhibit properties of increased crystallization and mechanical property change when heated over an extended period. The localised regions of increased rigidity in the form of spaced apart fracture conductors including increased crystallisation of material can be formed by heating or ultrasonic excitation of the body material at the desired positions of the fracture conductors.

International Publication No. WO2016/081996 provides a method for manufacturing a container having a fracturable opening, details of which are incorporated herein by reference. Crystallisation of the body material along the break path to provide localised regions of increased rigidity could be caused by selective heating at the fracture conductors to increase the level of crystallisation of the crystallisable material to above 30% and potentially as high as 85%. The optimal temperature for crystallisation of the fracturable area will be above the glass transition temperature (Tg) of the crystallisable polymer material. This glass transition temperature is typically about 70° C. depending on the formulation of the polymer material. The maximum rate of crystallisation may be reached at a temperature range from about 130° C. to about 200° C., and more preferably in the range from about 160° C. to about 170° C. The temperature may most preferably be about 165° C. The optimum length of time for the selective heating of the fracturable area can vary depending on whether the selective heating occurs within or after the production cycle of the shell portion. This time period may be from 3 to 5 seconds when the selective heating occurs within a standard production cycle. Alternatively, the localised crystallisation of the material could be produced through methods other than heating, such as ultrasonic excitation.

In each of the embodiments described above the thickness of material is substantially constant throughout the body and across the fracturable portion. Slight variations in the thickness may be apparent following the forming process of the container body, although these variations do not represent perforations or other intentional lines of thinning of the material.

The invention claimed is:

1. A container comprising:

a body having a cavity for containing one or more contents;

a flange arranged about a perimeter of the body;

a cover affixed to the flange for enclosing the contents within the cavity; and a fracturable portion including a bend extending across a side of the body from a first flange portion to a second flange portion, the fracturable portion bisecting the body into a first body portion on one side of the bend and a second body portion on the other side of the bend, wherein the bend has a depth which defines a break path along which the body is adapted to fracture when a user applies a force exceeding a predetermined level to each of the first and second body portions on either side of the bend, the bend having a plurality of spaced a part fracture conductors including a localised change of depth of the bend such that the depth of the bend is increased or reduced compared to the depth of the bend where no fracture conductor is present, each of said plurality of fracture conductors not extending outwardly beyond a plane defined by surfaces of the first and second body portions on either side adjacent to the bend, wherein a fracture point will initiate a fracture on the break path and the fracture can propagate from the fracture point in opposing directions along the break path toward each of a pair of termini with one termini at each of the first and second flange portions, and wherein the fracture conductors have a localised increase in rigidity of the fracturable portion such that the fracture conductors aid in guiding propagation of the fracture along the break path when the body is bent causing the first and second side portion to separate.

2. The container according to claim 1, wherein each fracture conductor includes a localised change of cross-sectional shape of the bend.

3. The container according to claim 2, wherein the localised change of depth and/or cross-sectional shape of the bend extends over a distance of 0.5 mm to 5 mm of the fracturable portion.

4. The container according to claim 2, wherein the localized change of depth and/or cross-sectional shape of the bend is a change of depth of 15% to 90% of a total depth of the bend.

5. The container according to claim 1, wherein the body is formed from a crystallisable material and each fracture conductor includes a localised change of crystallisation of the material at the bend.

6. The container according to claim 5, wherein the change of crystallisation of the material is caused by heating or ultrasonic excitation.

7. The container according to claim 1, wherein the fracture conductors are spaced apart along an elongate straight section of the break path to aid in guiding propagation of the fracture along the elongate straight section of the break path.

8. The container according to claim 1, wherein the break path has one or more curved sections, and wherein fracture conductors are positioned at transitional points on said curved sections to aid in guiding propagation of the fracture along the break path.

9. The container according to claim 1, wherein the break path has one or more angled sections, and wherein fracture conductors are positioned at transitional points on said angled sections to aid in guiding propagation of the fracture along the break path.

10. The container according to claim 1, wherein the body and flange are formed from a material including: polystyrene, polypropylene, polyethylene terephthalate (PET), amorphous polyurethane terephthalate (APET), polyvinyl chloride (PVC), high density polyethylene (HDPE), low density polyethylene (LDPE), polylactic acid (PLA), bio material, mineral filled material, thin metal formed material, acrylonitrile butadiene styrene (ABS) or laminate.

11. The container according to claim 1, wherein the body and flange are formed by at least one of sheet thermoforming, injection moulding, compression moulding or 3D printing.

12. The container according to claim 1, wherein the cover is bonded and sealed to the flange through one of heating, ultrasonic welding, pressure sensitive adhesive, heat actuated adhesive or another type of adhesive.

13. The container according to claim 1, wherein the bend is formed by an intersection between the first body portion and the second body portion, and the bend comprises sections where no facture conductors are present, and wherein at the sections where no fracture conductors are present each of the first and second body portions approaches the intersection as a straight line or a curve.

14. The container according to claim 13, wherein the intersection between the first and second body portions forms an angle of between 20° and 170°.

15. The container according to claim 1, wherein the first and second flange portions have an increased flange width compared to sections of the flange adjacent the first and second flange portions.

16. The container according to claim 1, wherein the first and second flange portions have a flange width that is substantially the same as sections of the flange adjacent the first and second flange portions, and wherein the bend transitions from the body to the flange in a straight line or curve to provide the flange width at the first and second flange portions.

17. The container according to claim 1, wherein a thickness of the body is substantially constant along the break path.

18. The container according to claim 13, wherein the intersection between the first and second body portions forms an angle of between 45° and 105°.

* * * * *